US008713821B2

(12) United States Patent
Nishiwaki et al.

(10) Patent No.: US 8,713,821 B2
(45) Date of Patent: May 6, 2014

(54) ATHLETIC SHOES HAVING AN UPPER WHOSE FITTING PROPERTY IS IMPROVED

(75) Inventors: Tsuyoshi Nishiwaki, Kobe (JP); Noboru Nakabe, Kobe (JP); Kiyomitsu Kurosaki, Kobe (JP); Toshikazu Kayano, Kobe (JP)

(73) Assignee: Asics Corporation, Hyogo (JP)

( * ) Notice: Subject to any disclaimer, the term of this patent is extended or adjusted under 35 U.S.C. 154(b) by 560 days.

(21) Appl. No.: 12/915,369

(22) Filed: Oct. 29, 2010

(65) Prior Publication Data

US 2011/0041362 A1 Feb. 24, 2011

Related U.S. Application Data

(63) Continuation of application No. 10/547,645, filed as application No. PCT/JP2004/005335 on Apr. 14, 2004, now Pat. No. 7,823,298.

(30) Foreign Application Priority Data

Apr. 24, 2003 (JP) ..... 2003-119887
Oct. 31, 2003 (JP) ..... 2003-371830

(51) Int. Cl.

| | |
|---|---|
| ***A43C 11/00*** | (2006.01) |
| ***A43B 3/26*** | (2006.01) |
| ***A43B 23/04*** | (2006.01) |
| *A43B 5/10* | (2006.01) |

(52) U.S. Cl.

CPC ..... *A43B 23/045* (2013.01); *A43B 23/047* (2013.01); *A43B 5/10* (2013.01)
USPC ..... 36/88; 36/93; 36/50.1; 36/97

(58) Field of Classification Search

CPC ..... A43B 5/10; A43B 23/047; A43B 23/045
USPC ..... 36/88, 93, 103, 102, 51, 50.1
See application file for complete search history.

(56) References Cited

U.S. PATENT DOCUMENTS 290,460 A * 12/1883 Mitchell ..... 36/51
1,949,318 A 2/1934 Markowsky (Continued)

FOREIGN PATENT DOCUMENTS

DE 3415960 11/1984
DE 4018518 1/1991

(Continued)

OTHER PUBLICATIONS

Catalog#1 Kayano 10th Anniversary, New Biomorphic Fit Technology, May 2003.

(Continued)

*Primary Examiner* — Jila M Mohandesi
(74) *Attorney, Agent, or Firm* — Mintz Levin Cohn Ferris Glovsky and Popeo, P.C.

(57) ABSTRACT

The present invention relates to the upper U of an athletic shoe comprising a first opening 1 out of which the foot sticks upwards during wearing and a second opening 2 which is closed with a tongue. The two openings 1, 2 are continuous with each other, and the upper U comprises a medial side stretchable part 51 which covers a part of a medial side face of an arch of the foot, a lateral side stretchable part 50 which covers a part of a lateral side face of a ball of a little toe (a fifth toe), a front part 3 located forward of the two stretchable parts 50, 51 and a rear part 4 located backward of the two stretchable parts. Each of the stretchable parts 50, 51 is provided so as to essentially cross one of side faces of the upper U from a top surface of a sole S to the second opening 2. Young's modulus along the lengthwise direction L of the foot of each of the stretchable parts 50, 51 is set smaller than that of the front part 3 and the rear part 4.

4 Claims, 17 Drawing Sheets

(56) References Cited

U.S. PATENT DOCUMENTS

| | | | | | |
|---|---|---|---|---|---|
| 2,158,153 | A | | 5/1939 | Roberts et al. | |
| 3,583,081 | A | | 6/1971 | Hayashi | |
| 3,821,858 | A | | 7/1974 | Haselden | |
| 3,925,913 | A | | 12/1975 | Del Vecchio | |
| 4,255,876 | A | | 3/1981 | Johnson | |
| 4,342,161 | A | | 8/1982 | Schmohl | |
| 4,354,319 | A | | 10/1982 | Block et al. | |
| 4,447,967 | A | | 5/1984 | Zaino | |
| 4,489,509 | A | * | 12/1984 | Libit | 36/7.1 R |
| 4,541,186 | A | * | 9/1985 | Mulvihill | 36/114 |
| 4,542,598 | A | * | 9/1985 | Misevich et al. | 36/114 |
| 4,562,652 | A | | 1/1986 | Hensler | |
| 4,622,763 | A | | 11/1986 | Adams | |
| 4,694,591 | A | | 9/1987 | Banich et al. | |
| 4,704,808 | A | | 11/1987 | Bianchini et al. | |
| 4,736,531 | A | | 4/1988 | Richard | |
| 4,756,098 | A | | 7/1988 | Boggia | |
| 4,769,927 | A | | 9/1988 | Ligett et al. | |
| 4,813,158 | A | | 3/1989 | Brown | |
| 4,858,339 | A | | 8/1989 | Hayafuchi et al. | |
| 4,876,806 | A | | 10/1989 | Robinson et al. | |
| 4,944,099 | A | * | 7/1990 | Davis | 36/97 |
| 4,949,476 | A | | 8/1990 | Anderie | |
| 5,243,772 | A | | 9/1993 | Francis et al. | |
| 5,307,569 | A | | 5/1994 | Melcher | |
| 5,377,430 | A | | 1/1995 | Hatfield | |
| 5,430,959 | A | | 7/1995 | Mitsui | |
| 5,497,564 | A | | 3/1996 | Allen et al. | |
| 5,533,279 | A | | 7/1996 | Mitsui et al. | |
| 5,564,203 | A | | 10/1996 | Morris | |
| 5,682,685 | A | * | 11/1997 | Terlizzi | 36/8.3 |
| 5,692,320 | A | | 12/1997 | Nichols | |
| 5,765,296 | A | | 6/1998 | Ludemann | |
| D402,456 | S | | 12/1998 | Greenberg | |
| D407,202 | S | | 3/1999 | Cass | |
| D419,756 | S | | 2/2000 | Edwards | |
| 6,029,376 | A | | 2/2000 | Cass | |
| 6,052,921 | A | | 4/2000 | Oreck | |
| 6,108,943 | A | | 8/2000 | Hudson et al. | |
| 6,148,544 | A | | 11/2000 | Keen et al. | |
| 6,151,800 | A | * | 11/2000 | Kerr et al. | 36/8.3 |
| D444,622 | S | | 7/2001 | Wilson | |
| D448,550 | S | | 10/2001 | Yang | |
| 6,467,194 | B1 | | 10/2002 | Johnson | |
| 6,477,793 | B1 | | 11/2002 | Pruitt et al. | |
| D467,412 | S | | 12/2002 | Morris | |
| D468,087 | S | | 1/2003 | Estey | |
| D474,008 | S | | 5/2003 | Masullo | |
| 6,606,804 | B2 | | 8/2003 | Kaneko et al. | |
| 6,658,766 | B2 | | 12/2003 | Krauetter | |
| 6,662,469 | B2 | | 12/2003 | Belley et al. | |
| 6,665,960 | B2 | | 12/2003 | Parisotto | |
| 2002/0078591 | A1 | | 6/2002 | Morrone | |
| 2002/0166260 | A1 | | 11/2002 | Borsoi | |
| 2002/0178610 | A1 | | 12/2002 | Cheng | |
| 2003/0150136 | A1 | | 8/2003 | Johnson | |
| 2003/0159312 | A1 | | 8/2003 | Farys et al. | |
| 2003/0192204 | A1 | | 10/2003 | Miller et al. | |

FOREIGN PATENT DOCUMENTS

| | | | |
|---|---|---|---|
| DE | 4018518 | A1 | 1/1991 |
| DE | 3925656 | A1 | 2/1991 |
| EP | 0047710 | | 3/1982 |
| EP | 0672362 | A1 | 9/1995 |
| JP | 31-19157 | | 12/1931 |
| JP | 7-11966 | | 9/1932 |
| JP | 11-636 | | 1/1936 |
| JP | 33-005240 | | 4/1958 |
| JP | 59-108405 | | 7/1984 |
| JP | 60-018082 | | 6/1985 |
| JP | 60-18082 | | 6/1985 |
| JP | 1-26245 | | 8/1989 |
| JP | 01-026245 | | 8/1989 |
| JP | 01-139710 | | 9/1989 |
| JP | 02-116807 | | 9/1990 |
| JP | 04-107608 | | 9/1992 |
| JP | 3010154 | | 2/1995 |
| JP | 3025914 | | 4/1996 |
| JP | 08-317806 | | 12/1996 |
| JP | 11-18803 | A | 1/1999 |
| JP | 2000-184902 | | 7/2000 |
| JP | 2000-287704 | | 10/2000 |
| JP | 2002-209608 | | 7/2002 |
| JP | 2002-345506 | A | 12/2002 |

OTHER PUBLICATIONS

Catalog#2 ASICS Spring 2004 Footwear, May 2003.

Catalog #3 ASICS 2004 Spring & Summer Shoes Lineup, Jul. 2003.

Office Action dated Sep. 13, 2011, issued by the German Patent Office, in connection with corresponding German Patent Application No. 112004000536.1.

* cited by examiner (lateral side)

(lateral side)

(medial side)

(lateral side)

(lateral side)

(lateral side)

(lateral side)

(medial side)

(lateral side)

(lateral side)

FIG. 16 (a) PRIOR ART
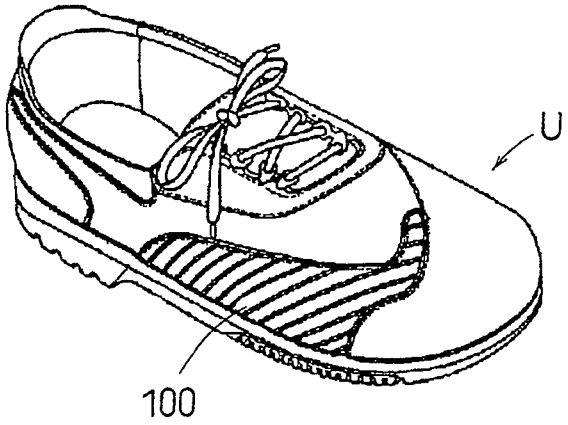
FIG. 16 (b) PRIOR ART
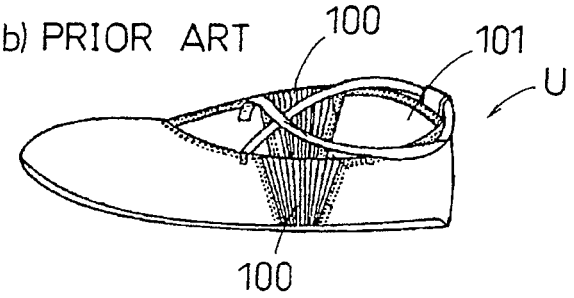
FIG. 16 (c) PRIOR ART
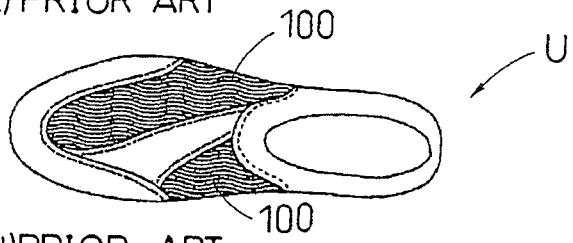
FIG. 16 (d) PRIOR ART
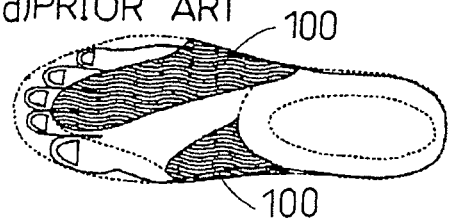

ATHLETIC SHOES HAVING AN UPPER WHOSE FITTING PROPERTY IS IMPROVED

CROSS REFERENCES TO RELATED APPLICATIONS

This is a continuation application of U.S. application Ser. No. 10/547,645 filed on Sep. 1, 2005, now U.S. Pat. No. 7,823,298 which is a national phase application based on PCT/JP04/05335 filed Apr. 14, 2004, which claims priorities of Japanese 2003-119887 filed on Apr. 24, 2003 and Japanese 2003-371830 filed on Oct. 31, 2003. The entire disclosures of these applications are incorporated herein by reference.

TECHNICAL FIELD

The present invention relates to an athletic shoe having an upper whose fitting property is improved.

BACKGROUND ART

Generally, an upper of a shoe is designed in view of a shape of a foot in a stationary state. However, at the time of exercise (for example, walking, running etc.), the shape of the foot varies continuously in the shoe. That is, at the time of exercise, the foot often comes away from the sole of the shoe, or the upper often prevents the foot from deforming naturally, because the upper cannot deform in accordance with the variation of the shape of the foot. Therefore, considering the upper as a component which makes the sole follow the foot, it is desirable that the upper deforms in accordance with the variation of the shape of the foot.

That is, because the shape of the foot varies at the time of exercises, a shoe is required to have high fitting property with respect to the foot. To improve the fitting property, it is desirable that the strain distribution of the upper resembles that of the foot.

The shoes of the first patent document (Japanese Utility Model Laid-Open No. 4-107608, FIG. 1 therein), the second patent document (Japanese Utility Model (examined) No. 60-18082, FIG. 1 therein), the third patent document (Japanese Patent Laid Open No. 2000-287704, FIG. 2 therein), the fourth patent document (Japanese Utility Model (examined) No. 1-26245, FIG. 1 therein), and the fifth patent document (Japanese Patent Laid Open No. 2000-184902, abstract therein) are known as shoes having improved fitting property.

FIG. 16(*a*) shows the shoe disclosed in the first patent document. In this shoe, a part of the lateral side of an upper U is formed with elastic member 100.

FIG. 16(*b*) shows the shoe disclosed in the second patent document. In this shoe, a part of both sides of an upper U is formed with elastic member 100.

FIG. 16(*c*) and FIG. 16(*d*) show the third patent document. In this shoe, both sides of a front part of an upper U are formed with elastic member 100.

FIG. 17(*a*) shows the shoe disclosed in the fourth patent document. In this shoe, a part of an upper U anterior to an opening is formed with bendable member 100.

FIG. 17(*b*) shows the shoe disclosed in the fifth patent document. In this shoe, a notched portion 102 in wedge shape is formed with stretchable member 100. The notched portion 102 extends shortly from the opening 103 of the upper U.

DISCLOSURE OF INVENTION

However, these shoes are not designed to deform so as to follow the deformation of the foot during running, as described below.

FIG. 2(*a*) and FIG. 2(*b*) are perspective views of the foot.

Generally, during running, runners raise their heel so as to kick the ground. At this time, the behavior of a front portion of the foot, which is located forward of a vicinity 81 of the arch in the medial side of the foot and a vicinity 80 of the ball of the little toe (the fifth toe) shown in FIG. 2(*a*) and FIG. 2(*b*), is quite different from that of a rear portion of the foot which is located backward thereof. This difference in behavior is not evident when the foot is in a stationary state.

The vicinity 81 of the arch in the medial side of the foot includes the region covering the Lisfranc('s) joint and its neighboring region. The vicinity 80 of the ball of the little toe (the fifth toe) includes the region covering distal caput (head) of a fifth metatarsal bone and its neighboring region. Strain distribution between the front and back of these regions varies very much. The strain distribution at the time of running in the front portion of the foot in front of the regions is discontinuous with that in the rear portion of the foot behind the regions.

In the shoes disclosed in the above patent documents, herein, both the arch in the medial side of the foot and the ball of the little toe are not covered with a stretchable member. Therefore, during running, the deformation of the shoe does not follow that of the foot. The, shoe feels stiff to the wearer between the foot and the shoe, and the shoe cannot adequately conform to the foot. As a result, the shoe interferes with the flexure or movement of the foot during exercise.

In the shoes shown in the second patent document, the elastic members 100 are provided on the medial side and the lateral side of the upper U and are opposite each other. Therefore, the upper U is likely to bend unnecessarily, and such shoes are likely to get out of shape and lack stability.

An object of the invention is to solve the above discussed problems by an improved upper of a shoe having enhanced fitting property.

In order to achieve the object, according to a first aspect of the invention, an athletic shoe suitable for exercise is provided. Such shoe comprises a sole for absorbing the shock of landing and an upper for covering an instep of a foot.

The upper includes a first opening out of which the foot sticks upwards during wearing and a second opening which is closed with a tongue. The two openings are continuous with each other in the longitudinal direction. The upper comprises a medial side stretchable part which covers a part of a medial side face of the foot, a lateral side stretchable part which covers a part of a lateral side face of the foot, a front part located forward of the two stretchable parts, and a rear part located backward of the two stretchable parts. Young's modulus along the lengthwise direction of the foot (the length of the foot) of each of the stretchable parts is less than that of the front part and the rear part.

The lateral side stretchable part is provided in an area from a region corresponding to distal caput (head) of a fifth metatarsal bone or its neighboring region to the second opening. That is, the area extends from a region essentially corresponding to the top edge of the distal caput of the fifth metatarsal bone to the second opening. The area includes a line which extends forwardly and obliquely upward from this region. That is, the area includes a line which is inclined to ascend as it goes forward. The lateral side stretchable part has a sufficient length to stretch along the lengthwise direction of the foot (the length of the foot) in this region.

Such a provision of the lateral side stretchable part from the region essentially corresponding to the top edge of the distal caput (head) of the fifth metatarsal bone to the second opening allows the region where strain distribution can increase sharply to be covered with a stretchable member. Therefore, the upper can deform according to the strain of the region, and so the fitting property of the shoe is improved.

In the present invention, by the use of the term "the region essentially corresponding to a top edge of distal caput (head) of a fifth metatarsal bone", it is meant to include not only the region just corresponding to the top edge of the distal caput of the fifth metatarsal bone but also its surrounding vicinity. Accordingly, for example, even if the lateral side stretchable part extends from a location slightly above the region just corresponding the top edge of the distal caput of the fifth metatarsal bone to the second opening, the lateral side stretchable part is provided in the area from the region essentially corresponding to the top edge of the distal caput of the fifth metatarsal bone to the second opening.

The lateral side stretchable part has a sufficient length to stretch along the lengthwise direction of the foot in the region. This enables the front part located forward of the lateral side stretchable part and the rear part backward of the lateral side stretchable part work to function substantially independently without interference from each other. That is, provision of the lateral side stretchable part allows the front part and that of the rear part to move separately from each other. Thereby, the upper can deform under less restraint and does not prevent the active foot from deforming naturally, so that the fitting property is further improved. This action of the upper will be explained in detail in the following description of the embodiments.

According to another aspect of the invention, an athletic shoe suitable for exercise is provided which comprises a sole for absorbing the shock of landing and an upper for covering an instep of a foot. The upper defines a first opening out of which the foot sticks upwards during wearing and a second opening which is closed with a tongue. The two openings are continuous with each other. The upper comprises a medial side stretchable part which covers at least a portion, i.e., a part or whole, of a medial side face of an arch of the foot, a lateral side stretchable part which covers at least a portion, i.e., a part or whole, of a lateral side face of a ball of a little toe (a fifth toe), a front part located forward of the two stretchable parts, and a rear part located backward of the two stretchable parts. Each of the stretchable parts is provided so as to essentially cross one of the respective side faces of the upper from a top surface of the sole to the second opening. Young's modulus along the lengthwise direction of the foot of each of the stretchable parts is set smaller than that of the front part and the rear part.

As the heel is raised at the time of exercise and a vicinity of the arch and the ball of the little toe of the foot deforms, the medial side stretchable part and the lateral side stretchable part stretch and contract in accordance with deformation of the foot. Thus, the foot does not separate from the sole of the shoe, and the upper does not prevent the active foot from deforming naturally. That is, the upper has high fitting property.

Each of the stretchable parts essentially cross one of the respective side faces of the upper from the top surface of the sole to the second opening. Therefore, in the state of wearing the shoe with a shoelace tied or the state where the heel has not been raised yet, each of the stretchable parts contracts and the front part of the upper and the rear part of the upper fit to the front portion of the foot and the rear portion of the foot respectively.

In the present invention, the medial side stretchable part covers at least a part of the medial side face of the arch of the foot, and the lateral side stretchable part covers at least a part of the lateral side face of the ball of the little toe.

As described above, according to this aspect of the invention, since the medial side stretchable part and the lateral side stretchable part extend across the medial side face and the lateral side face of the upper respectively, and cover at least a part of the side of the arch of the foot and the ball of the little toe respectively at the time of exercise, the fitting property is improved.

In the present invention by the use of the term "essentially cross one of side faces of the upper from the top surface of the sole to the second opening" it is meant that a stretchable member is provided from the top surface of the sole to the second opening on the side face of the upper so as to allow a part of the upper along a rim of the second opening to stretch and contract. Therefore, for example, even if an eyelet stay is provided with the upper along the rim of the second opening, a part of the eyelet stay is notched and the lateral side face of the notched portion is merely covered with cloth and so on, the stretchable member "essentially cross" the side of the upper.

According to yet another aspect of the invention, an athletic shoe suitable for exercise is provided which comprises a sole for absorbing shock of landing and an upper for covering an instep of a foot. The upper defines a first opening out of which the foot sticks upwards during wearing and a second opening which is closed with a tongue. The two openings are continuous with each other. The upper comprises a medial side stretchable part which covers a part of a medial side face of the foot, a lateral side stretchable part which covers a part of a lateral side face of the foot, a front part located forward of the two stretchable parts, and a rear part located backward of the two stretchable parts. Each of the stretchable parts is provided so as to essentially cross one of the side faces of the upper from a top surface of the sole to the second opening. The Young's modulus along the lengthwise direction of the foot of the each of the stretchable parts is less than that of the associated front part and rear part. A front reinforcing member for reinforcing the front part is provided at a rear edge of the front part and a rear reinforcing member for reinforcing the rear part is provided at a front edge of the rear part. The Young's modulus of the upper on a lateral side of the foot corresponding to the location of the medial side stretchable part is greater than that of the medial side stretchable part. Likewise, the Young's modulus of the upper on a medial side of the foot corresponding to the location of the lateral side stretchable part is greater than that of the lateral side stretchable part. That is, since the stretchable parts do not face each other, the lateral side face of the upper opposite to or facing the medial side stretchable part has a greater Young's modulus than the medial side stretchable part. Likewise, the medial side face of the upper opposite to or facing the lateral side stretchable part has a greater Young's modulus than the lateral side stretchable part.

The front part and the rear part are separated from each other in the lengthwise direction of the foot. At the time of wearing the shoe, the stretchable parts stretch and contract in accordance with the motion of the foot so that the front part and the rear part of the upper fit to the foot. At that time, though the stretchable parts stretch and contract, the front part and the rear part of the upper fit to the toe and the heel respectively without getting out of shape, because the rear edge of the front part and the front edge of the rear part are reinforced by the rear reinforcing members.

The Young's modulus of the upper on the opposite side to which each of the stretchable parts faces is greater than that of such stretchable part. That is, the opposite side face of the upper facing each of the stretchable parts has greater Young's modulus than the stretchable parts. Thus, the upper supports the side of the foot, providing stability to the foot. When an upper has both sides facing each other of which are formed with soft or elastic material, neither side of the foot is supported and there is decreased stability for the foot.

According to this aspect of the invention, at the time of stretching and contraction of the stretchable parts, the upper does not get out of shape and the front part fits to the toe and the rear part fits to the heel, because the front part and the rear part are reinforced by the reinforcing member. Additionally, the upper does not lose the function of supporting the foot, because the Young's modulus of the opposite side face corresponding to each of the stretchable part is greater than that of the corresponding stretchable part.

In a preferred embodiment of the present invention, a edge portion of each of the stretchable parts in the vicinity of the second opening is formed with a material which allows each of the stretchable parts to stretch and contract. On the contrary, the front part and the rear part comprises a peripheral edge which is adjacent to the second opening respectively, and each of the peripheral edges is formed of material of which is substantially inelastic or difficult to stretch.

Thus the edge portion of the stretchable part is easy to stretch and contract. Therefore, the resistance at the time of the bend of the foot becomes small so as to allow the smooth bending action of the foot; whereas the peripheral edges of the front part and the rear part are formed of a material which is substantially more difficult to stretch. Therefore, the shoe is hard to get out of shape when the shoe is tied with a shoelace, and so the fitting property of the upper does not deteriorate.

In the present invention, by the use of the term "material which is substantially difficult to stretch" or "material which is substantially inelastic", it is meant to include the materials of which ordinary athletic shoes uppers are formed, and which have a Young's modulus greater than the stretchable parts.

In another preferred embodiment of the present invention, each of the stretchable parts is substantially triangular or trapezoidal so as to become smaller in width along the lengthwise direction of the foot as it gets close to the second opening from the sole.

Such a triangular or trapezoidal shape for the stretchable parts permits the strain to the upper along the lengthwise direction of the foot, which is larger in the vicinity of the top surface of the sole than in the vicinity of the second opening, to conform to the strain of the foot.

In another embodiment of the present invention, each of the stretchable parts comprises plural sheets of cloth that overlap each other. Such a structure enables the plural sheets of cloth to deform independently of each other in the center region of each of the stretchable parts. That is, the plural sheets of cloth are stacked so as to be able to deform independently of each other in the center region.

In this embodiment the inner cloth of the plural sheets of cloth, which is in contact with the foot deforms in conformity with the deformation of the foot, and the outer cloth of said plural sheets of cloth deforms independently of the inner cloth. As a result, the gap between the deformation of the foot and that of the upper is bridged. That is, the difference between the deformation of the foot and that of the upper can be accommodated.

By the use of the term "cloth" herein it is meant a sheet-like material of which the upper of the shoe is formed and can include a sheet of rubber or resin, woven fabric, knitted fabric and/or nonwoven fabric.

In the present invention, preferably, the rim portion of the upper along the second opening is notched at a location corresponding to the medial side stretchable part. That is, the rim portion of the upper defines a lateral side notched portion and a medial side notched portion which are formed by cutting or separating the rim portion at a location corresponding to each of the stretchable parts. The notches of the rim portion formed on the medial and the lateral side of the foot allows the upper to bend easily in the vicinity of the second opening, significantly enhancing bending property of the shoe.

In this case, preferably, an elastic material of elastomer is integrally formed in a top rim portion of each of the stretchable parts along the notched portion, to enhance the stretching and contracting property of the upper and the durability of the stretchable part. The notched portion may be formed to be V-shaped or formed in any optional shape. Preferably, the notched portion is formed to be U-shaped so that stress concentration is relaxed, thus improving the durability of the stretchable part.

BRIEF DESCRIPTION OF DRAWINGS

FIG. 16(*a*), FIG. 16(*b*), FIG. 16(*c*), and FIG. 16(*d*) are perspective views and plan views showing conventional shoes.

BEST MODE FOR CARRYING OUT THE INVENTION

Hereinafter, embodiments of the invention will be described with reference to the drawings.

First Embodiment

Figure 3:
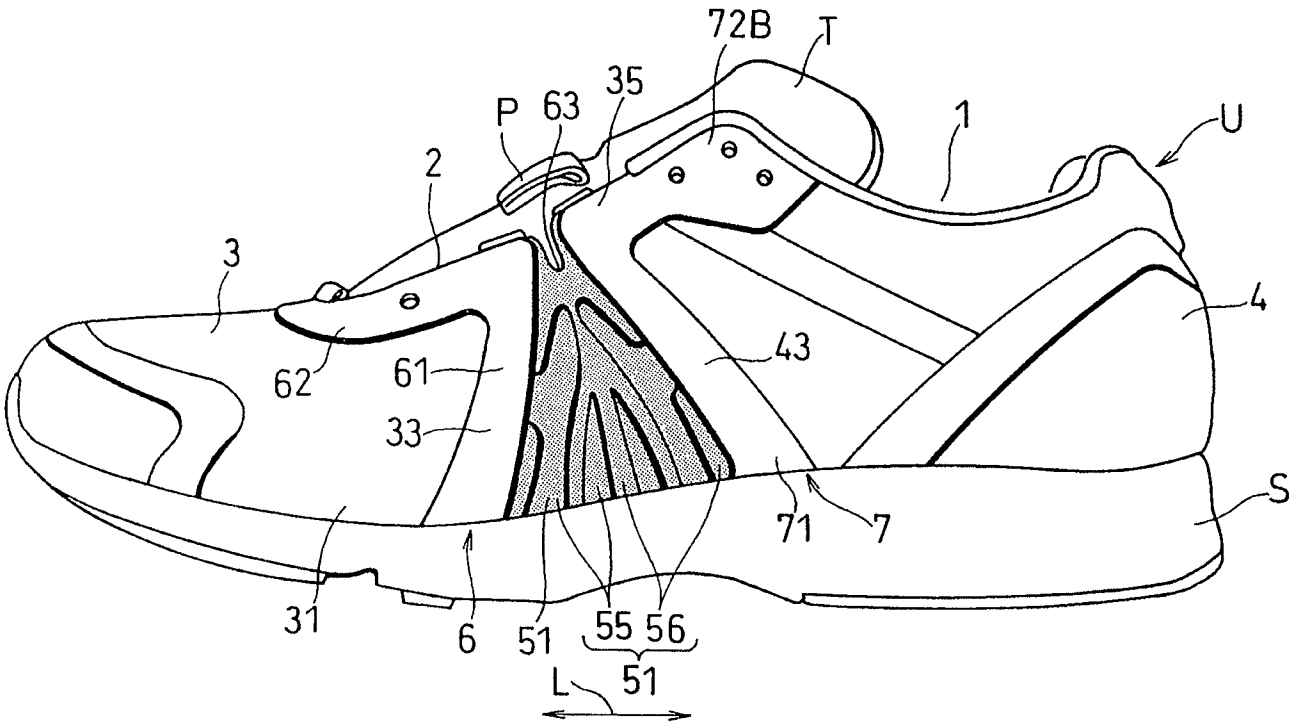
FIG. 3 is a side view showing a medial side face of the shoe of a first embodiment.
Figure 4:
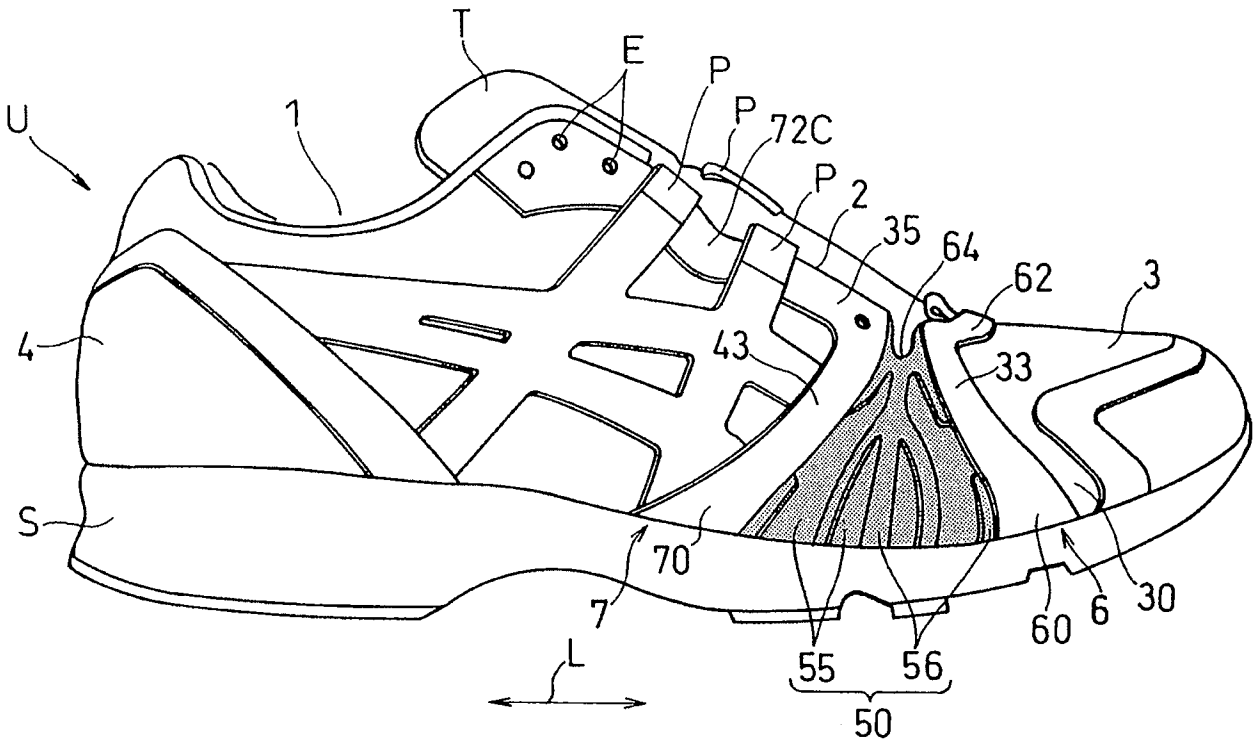
FIG. 4 is a side view showing a lateral side face of the same shoe.

FIG. 3 to FIG. 7 show a first embodiment. FIG. 3 shows a medial side face of a shoe (for a right foot) of the first embodiment, and FIG. 4 shows a lateral side face of the same shoe. In FIG. 3 to FIG. 6, in order to understand easily the area where the stretchable parts are provided, the stretchable parts are dot-meshed.

As shown in FIG. 3, the shoe comprises a sole S and an upper U.

The upper comprises a first opening 1, a second opening 2, a lateral side stretchable part 50, a medial side stretchable part 51, a front part 3 and a rear part 4.

Figure 5:
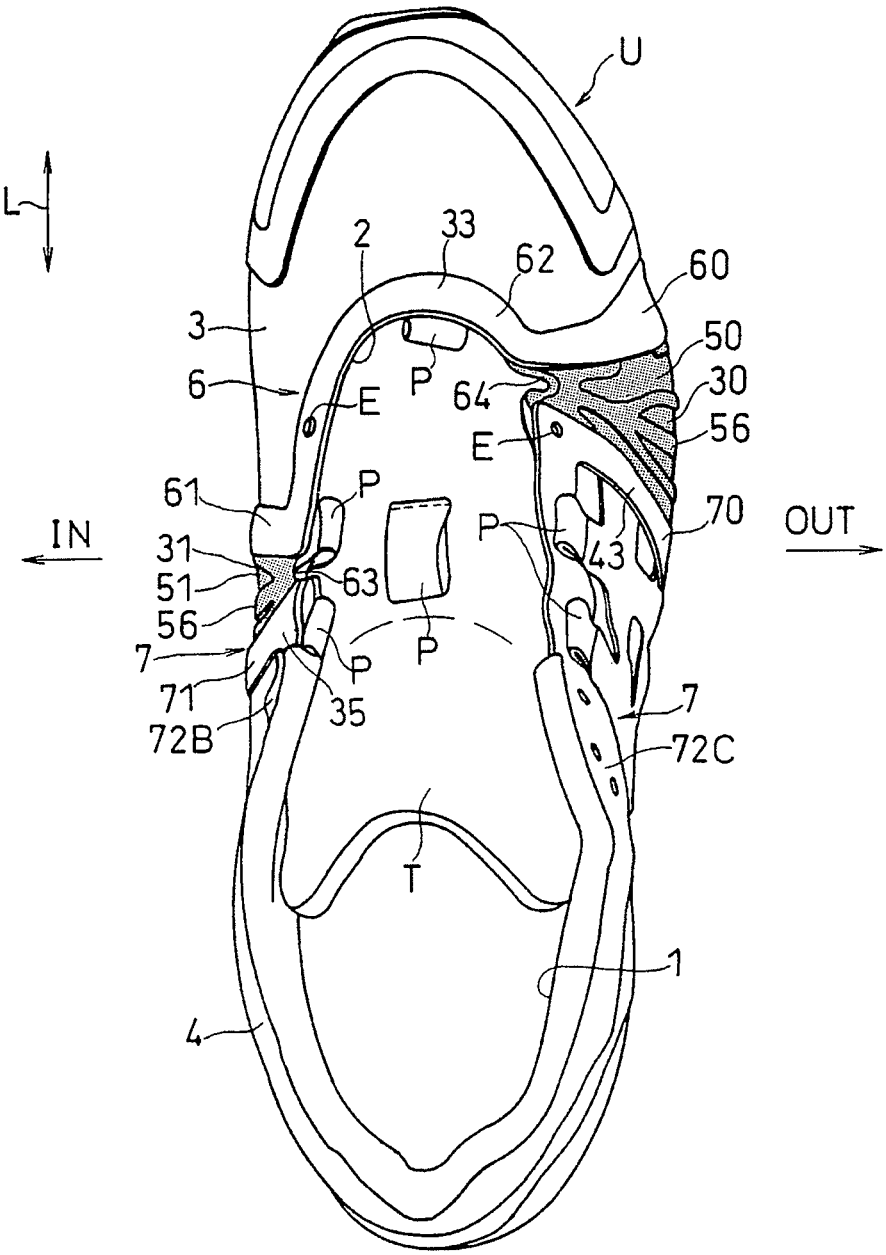
FIG. 5 is a plan view of the same shoe.

The first opening 1 and the second opening 2, as shown in FIG. 5, are formed at the center of the upper U. The first opening 1 is an opening out of which the foot sticks upwards during wearing. The second opening 2 is an opening which is closed with a tongue T. The first opening 1 is located at the back of the second opening 2 and is continuous with the second opening 2. The second opening 2 is over the front of the footinstep.

Figure 6:
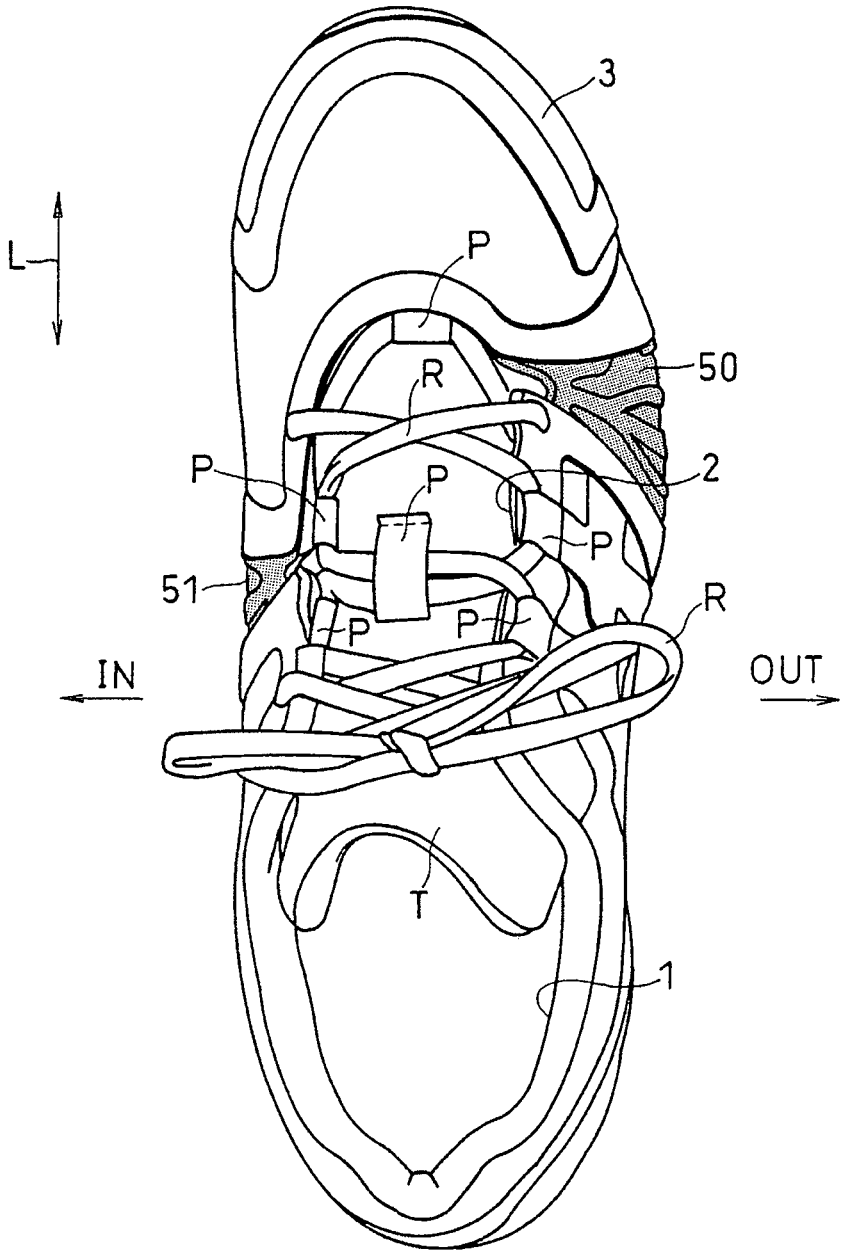
FIG. 6 is a plan view of the same shoe with the shoelace tied.

The tongue T is sewn onto the upper U in front of the second opening 2. A tube-like loop P is formed at the center of the upper surface the tongue T. At the time of putting on the shoe, as shown in FIG. 6, a lace R may be inserted through the loop P.

As shown in FIG. 5, the medial side and lateral side stretchable parts 50, 51, front part 3 and rear part 4 are located around the two openings 1, 2. The medial side stretchable part 51 is formed on the medial side face 31 of the upper U, located on the medial side of the second opening 2. The lateral side stretchable part 50 is formed on the lateral side face 30 of upper U, located on the lateral side of the second opening 2. The front part 3 is located forward of the two stretchable parts 50, 51. The rear part 4 is located backward of the two stretchable parts 50, 51. That is, in the upper U, the front part 3 and the rear part 4 are separated from each other by the two openings 1, 2 and the two stretchable parts 50, 51.

Each of the two stretchable parts 50, 51 is formed of material which has high stretching and contracting property. On the contrary, the front part 3 and the rear part 4 are formed of material whose stretching and contracting property is less than that of the two stretchable parts 50, 51. That is, the Young's modulus along the length and width of the foot is set smaller than that of the front part 3 the rear part 4.

Next, the location of each of the two stretchable parts 50, 51 will be described.

As described above and referring to FIGS. 2(*a*) and 2 (*b*), during running, the behavior of a front portion of the foot, which is located forward of the medial side face 81 of the arch in the medial side of the foot and located forward of the lateral side face 80 of the ball of the little toe, is quite different from that of the rear portion of the foot which is located backward thereof.

Figure 1:
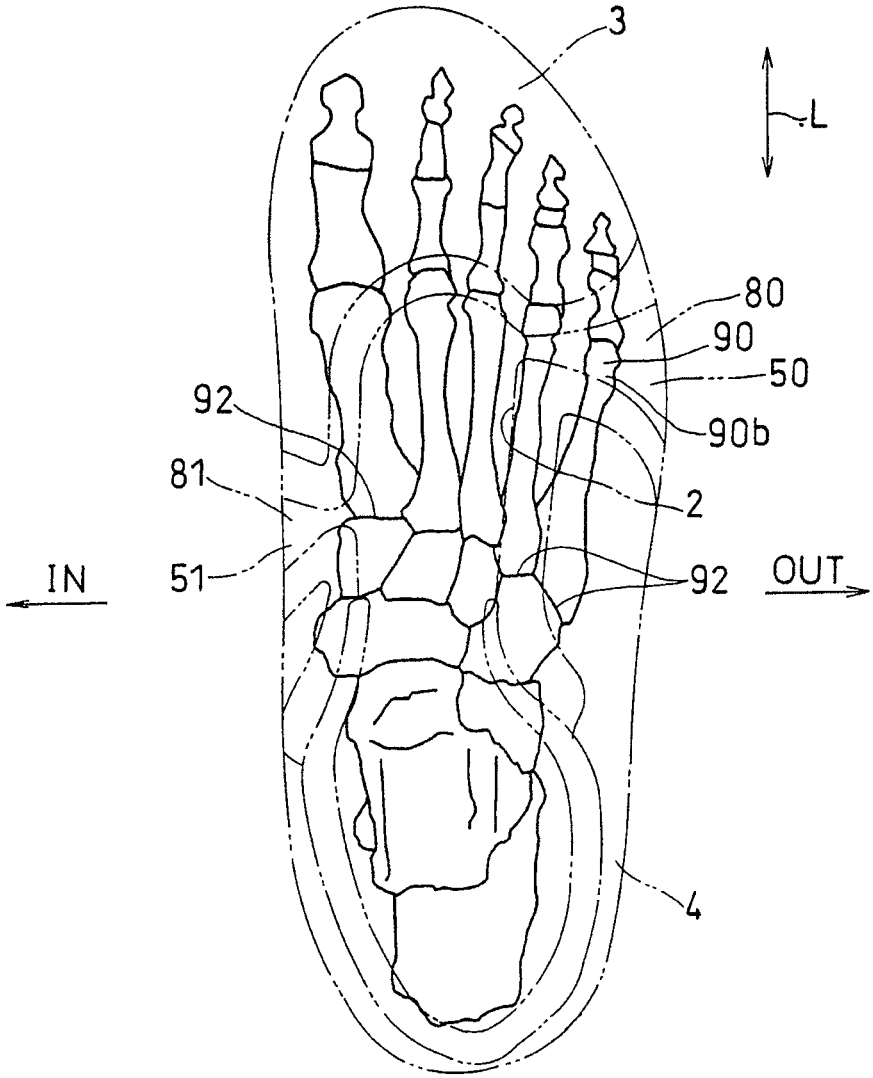
FIG. 1 is a schematic plan view showing the relationship between bones of the foot and the shoe of the invention.

The medial side face 81 of the arch of the foot and the lateral side face 80 of the little toe are located so as to be obliquely opposed to each other. Referring now to FIG. 1, the medial side face 81 and the lateral side face 80 are covered with the medial side stretchable part 51 and the lateral side stretchable part 50, respectively. Therefore, the two stretchable parts 50, 51 are located so as to be obliquely opposed to each other.

Still referring to FIG. 1, in addition, the lateral side stretchable part 50, covers the distal caput (head) 90 of a fifth metatarsal bone and its neighboring region and is provided in an area from the region to the second opening 2. The area where the lateral side stretchable part 50 is provided includes a line which extends forwardly and obliquely upward from the rear end 90*b* of the distal caput (head) 90 of a fifth metatarsal bone to the second opening 2. The lateral side stretchable part 50 has a length along the lengthwise direction L of the foot in the neighboring region of the distal caput (head) 90 of a fifth metatarsal bone so that the lateral side stretchable part 50 can stretch and contract along the lengthwise direction L of the foot.

On the other hand, the medial side stretchable part 51 covers the Lisfranc('s) joint 92 on the medial side of the foot and its neighboring region and is provided in an area from the region to the second opening 2. The medial side stretchable part 51 has a length along the lengthwise direction L of the foot in the neighboring region of the Lisfranc('s) joint 92 so that the medial side stretchable part 51 can stretch and contract along the lengthwise direction L of the foot.

As shown in FIG. 5, the rear part is provided at the opposite position of the upper U facing the medial side stretchable part 51, and the front part 3 is provided at the opposite position of the upper U facing the lateral side stretchable part 50. That is, the lateral side face of rear part 4 is opposite the medial side stretchable part 51, and the medial side face of front part 3 is opposite the lateral side stretchable part 50.

As shown in FIG. 4, the lateral side stretchable part 50, is provided so as to essentially cross a lateral side face 30 of the upper U from the top surface of the sole S to the second opening 2. As shown in FIG. 3, the medial side stretchable part 51, is also provided so as to essentially cross a medial side face 31 of the upper U from the top surface of the sole S to the second opening 2. That is, each of the stretchable parts 50, 51 extends across one of side faces of the upper U.

Next, the shape of each of the two stretchable parts 50, 51 will be described.

Referring to FIGS. 3 and 4, each of the two stretchable parts 50, 51 is formed so as to become smaller in width along the lengthwise direction L of the foot as it gets close to the top portion of the foot from the sole of the foot. That is, as shown in FIG. 3, the medial side stretchable part 51 is formed to be substantially triangular or trapezoidal so as to become smaller in width along the lengthwise direction L of the foot as it gets close to the second opening 2 from the sole S. The lateral side stretchable part 50, as shown in FIG. 4, is of similar shape to that of the medial side stretchable part 51.

As shown in FIGS. 3-5, a rim portion 35 of the upper U which is provided along the second opening 2 is notched at a location corresponding to the two stretchable parts 50, 51, to form notched portions 63, 64. That is, the medial side notched portion 63 is formed at the rim portion 35 at the location corresponding to the medial side stretchable part 51, and the lateral side notched portion 64 is formed at the rim portion 35 at the location corresponding to the lateral side stretchable part 50. The notched portions 63, 64 are included by the rim portion 35 of the upper U. The notched portions 63, 64 formed on the medial and the lateral side of the foot allows the upper U to bend easily in the vicinity of the second opening 2, to thereby improve the bending property of the shoe.

It is preferable to form the medial side notched portion 63 (FIG. 3) and the lateral side notched portion 64 (FIG. 4) to be U-shaped. However, the notched portions 63, 64 may be formed to be V-shaped or formed in any optional shape.

Next, reinforcing members 6, 7 for reinforcing the front part 3 and the rear part 4 will be described.

As shown in FIGS. 3-5, a belt-like front reinforcing member 6 is provided at the rear edge 33 of the front part 3. The front reinforcing member 6 comprises a first medial side stay portion 61, a first lateral side stay portion 60, and a front eyelet stay portion 62, and these portions 61, 60, 62 are formed to be continuous.

The first medial side stay portion 61, as shown in FIG. 3, extends from the top surface of the sole S on the medial side of the foot to the vicinity of the second opening 2. The first medial side stay portion 61 extends linearly along the front edge of the medial side stretchable part 51.

As shown in FIG. 4, the lateral side stretchable part 50 extends from the top surface of the sole S on the lateral side of the foot to the vicinity of the second opening 2. The first lateral side stay portion 60 is formed linearly along the front edge of the lateral side stretchable part 50.

The front eyelet stay portion 62, as shown in FIG. 5, is located between the first medial side stay portion 61 and the first lateral side stay portion 60. The front eyelet stay portion 62 is formed curvedly so as to be disposed along the front edge of the second opening 2.

The tube-like loops P are sewn onto the front eyelet stay portion 62 and the first medial side stay portion 61 on the side of the second opening 2. Eyelet holes E are formed in the first medial side stay portion 61.

As shown in FIG. 3-5, a belt-like rear reinforcing member 7 is provided at the front edge 43 of the rear part 3. The rear reinforcing member 7 comprises a second medial side stay portion 71, a second lateral side stay portion 70, a medial side eyelet stay portion 72B (FIG. 3), and a lateral side eyelet stay portion 72C (FIG. 4). As shown in FIG. 3, the second medial side stay portion 71 and the medial side eyelet stay portion 72B are continuous with each other. As shown in FIG. 4, the second lateral side stay portion 70 and the lateral side eyelet stay portion 72C are continuous with each other.

The second medial side stay portion 71, as shown in FIG. 3, extends from the top surface of the sole S on the medial side of the foot to the vicinity of the second opening 2. The second medial side stay portion 71 extends linearly along the rear edge of the medial side stretchable part 51. The medial side eyelet stay portion 72B extends linearly along the medial side edge of the second opening 2.

The second lateral side stay portion 70, as shown in FIG. 4, extends from the top surface of the sole S on the lateral side of the foot to the vicinity of the second opening 2. The second lateral side stay portion 70 is formed linearly along the rear edge of the lateral side stretchable part 50. The lateral side eyelet stay portion 72C extends linearly along the lateral side edge of the second opening 2.

As shown in FIG. 5, tube-like loops P are sewn onto the medial side and lateral side eyelet stay portion 72B, 72C and eyelet holes are formed in the two eyelet stay portions 72B, 72C.

Next, materials of which the front part 3, the rear part 4, and the two stretchable part 50, 51 are formed will be described.

The front part 3 and the rear part 4 are formed by stacking cloths, such as woven fabric, knitted fabric (preferably bonded to each other), which are generally used in athletic shoes. According to the need, belt-like members for fixing core material are sewn onto top surface of said cloths Each of the two stretchable parts 50, 51 comprise a base material shown in cross section view in FIG. 7(*a*). The base material is formed by stacking or layering cloths 57, 58 which have stretching and contracting properties. Referring to FIG. 3, the cloths 57, 58 are sewn to each other at the rear edge 33 of the front part 3 and at the front edge 43 of the rear part 4. In the central region of each of the stretchable parts 50, 51, the cloths 57, 58 are neither bonded to each other nor sewn to each other, and so the cloths 57, 58 can freely slide over each other and deform separately from each other.

Figure 7A:
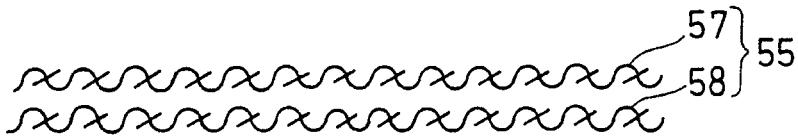
FIG. 7(*a*) is a sectional view showing a base material, FIG. 7(*b*) is a sectional view showing a stretchable part on which an elastic member is laminated and FIG. 7(*c*) is a sectional view showing a part of the upper at a rear edge of a front part.
Figure 7B:
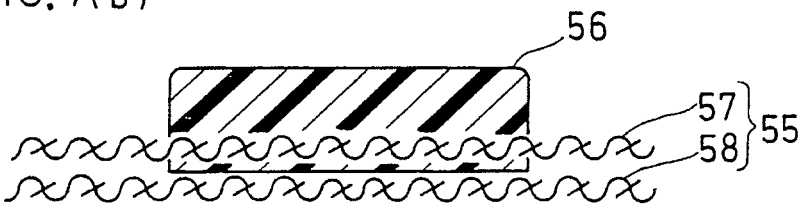
Figure 7C:
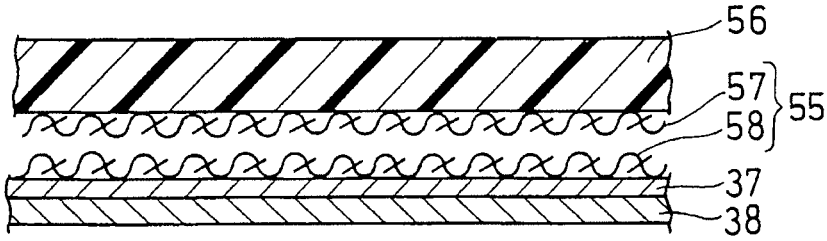

As shown in cross section view in FIG. 7(*b*), an elastic material 56 is provided on a part of the upper cloth 57 of the base material 55. The elastic material 56 gets into and adheres to the surface of a part of the upper cloth 57. The elastic material provides a means for controlling the direction of the stretch of the stretchable parts 50, 51.

As shown in FIG. 3, in the top rim portion of the medial side stretchable part 51 along the notched portion 63, the elastic material 56 is laminated on the base material 55. In addition, the elastic material 56 is laminated on the medial side stretchable part 51 so as to cross the medial side stretchable part 51 from the notched portion 63 to the top surface of the sole S. This inhibits the stretching along the vertical direction less than in the lengthwise direction of the foot.

On the lateral side stretchable part 50, as shown in FIG. 4, the elastic material 56 is laminated in the same manner.

On the other hand, as shown in cross section view in FIG. 7(*c*), at the position of the reinforcing members 6, 7 (FIG. 5), the cloths 57, 58 of the stretchable parts 50, 51 and materials 37, 38 of the front and rear parts 3, 4 are sewn to the belt-like material of the reinforcing member 6, 7.

At the time of putting on the shoe on the foot, after unfastening the lace R shown in FIG. 6, the foot is inserted into the shoe from the first opening 1 and the rear portion of the second opening 2. At this time, the medial side and lateral side stretchable parts 50, 51 become stretched a little so that the front part 3 fits the toe, of the foot and that the rear part 4 fits the heel of the foot.

Figure 2A:
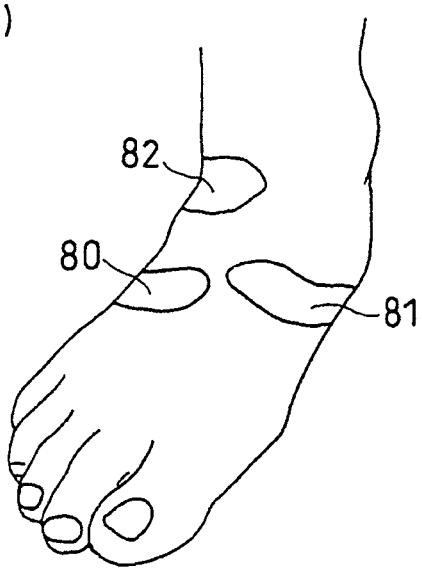
FIG. 2(*a*) and FIG. 2(*b*) are perspective views of the foot showing locations on the foot where strains occur (80, 81, 82) at the time of running.

Referring to FIG. 2*a*, at the time of running as the foot bends with the heel raised upward, the behavior of the foot differs very much between the front foot portion and the rear foot portion about a vicinity 81 of the arch in the medial side of the foot and a vicinity 80 of the ball of the little toe (the fifth toe). At this time, the upper U stretches in the vicinity of the top surface of the sole S (FIG. 3), and, contracts in the vicinity of the second opening 2. Since the stretchable parts 50 and 51 of this athletic shoe in the vicinity of the sole S are longer in the lengthwise direction L of the foot, and Young's modulus thereof along the lengthwise direction L of the foot is set small, the stretchable parts 50 and 51 can stretch easily in the vicinity of the sole S. On the other hand, since the notched portions 63 and 64 are formed in the stretchable parts 50 and 51 in the vicinity of the second opening 2, the stretchable parts 50 and 51 can contract easily in the vicinity of the second opening 2. Accordingly, the upper U can fit the foot.

Figure 2B:
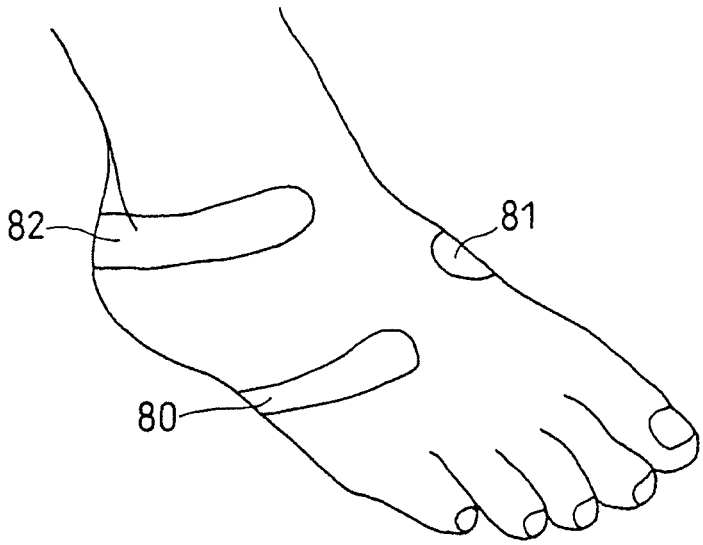

Referring to FIG. 2 and the lateral side foot portion 82, which is located under the ankle of the foot, the behavior of the foot differs substantially between the front and the rear about said lateral side foot portion 82. Accordingly, it is preferable to provide the stretchable member proximate to said lateral side foot portion 82 as well as in the vicinity 80 of the little toe and the vicinity 81 of the arch in the medial side of the foot.

Second Embodiment

Figure 8:
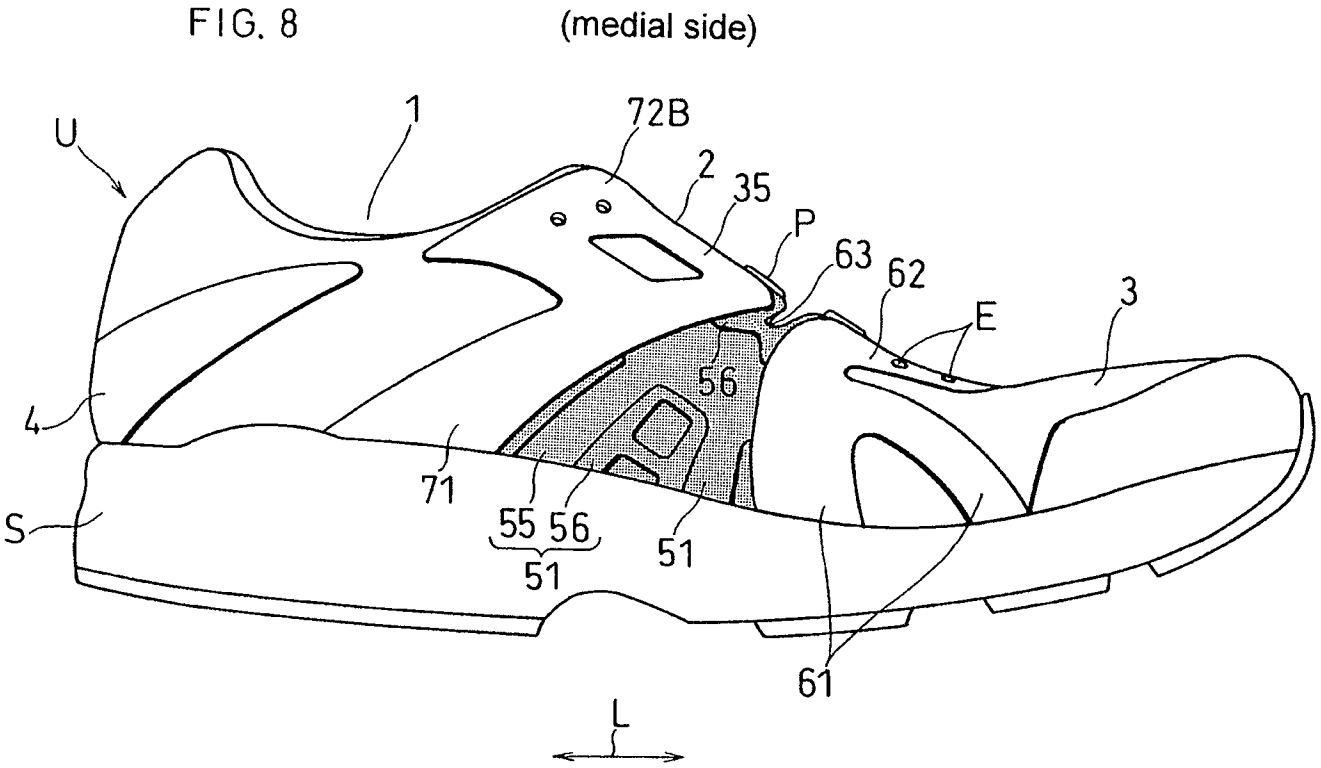
FIG. 8 is a side view showing a medial side face of the shoe of a second embodiment.
Figure 9:
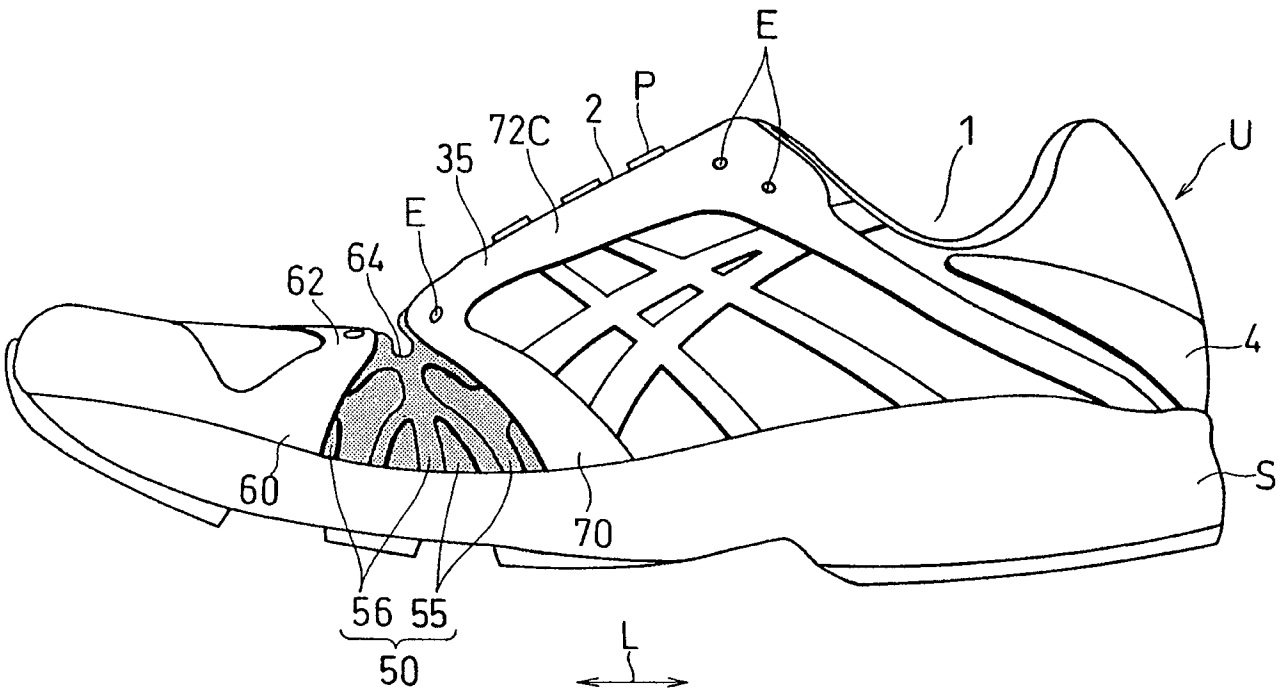
FIG. 9 is a side view showing a lateral side face of the same shoe.

FIG. 8 and FIG. 9 show a second embodiment of the shoe of this invention. FIG. 8 shows a medial side face of a shoe (for a left foot), and FIG. 9 shows a lateral side face for such shoe. In FIG. 8 and FIG. 9, in order to understand easily the area where the stretchable parts are provided, the stretchable parts are dot-meshed. In the following description of embodiments, the parts which are identical or corresponding to those of the first embodiment are designated by the same reference numerals as the first embodiment and the detailed description and illustration thereof will be omitted.

As shown in FIG. 8, in this embodiment, the elastic material 56 of the medial side-stretchable part 51 is separated in the vertical direction.

Further, as shown in FIG. 8, the first medial side stay portion 61 is formed to be bifurcated. In addition, as shown in FIG. 9, the lateral side eyelet stay portion 72C extends to the top surface of the sole S in the rear foot portion.

Third Embodiment

Figure 10A:
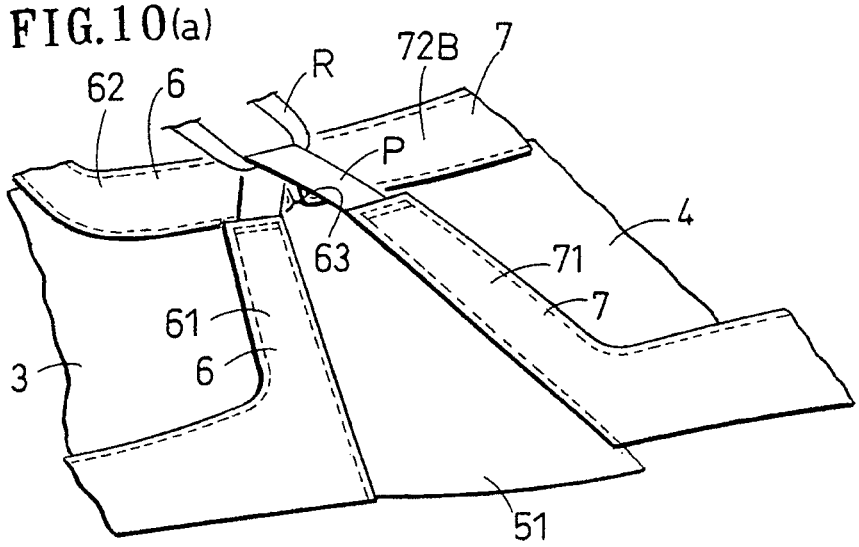
FIG. 10(*a*) is a perspective view showing a medial side stretchable part and its vicinity of a third embodiment and FIG. 10(*b*) is an exploded perspective view of the same.
Figure 10B:
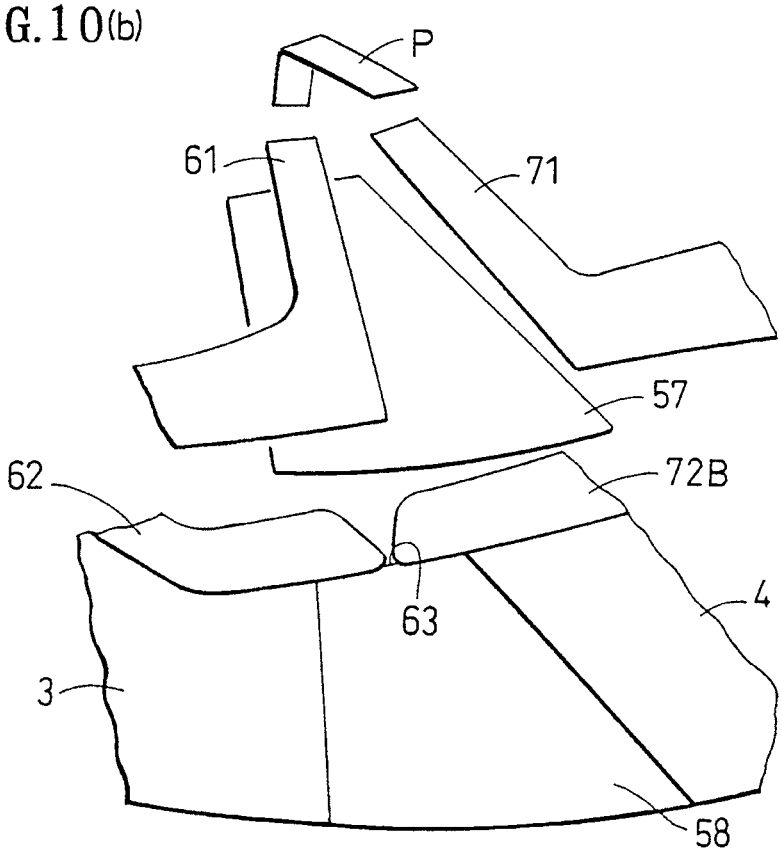

FIG. 10 shows a third embodiment of the shoe of this invention. FIG. 10(*a*) is a perspective view showing a medial side stretchable part 51 and its vicinity and FIG. 10(*b*) is an exploded perspective view thereof.

In this embodiment, as shown in FIG. 10(*a*), a loop P covers the medial side notched portion 63. As shown by the broken line, the ends of the loop P are sewn to the top edge of the first medial side stay portion 71 and the second medial side stay portion 61, but are not sewn to the eyelet stay portions 62, 72B. Accordingly, the loop P allows the medial side stretchable part 51 to stretch and contract.

Further, as shown in the exploded perspective view of FIG. 10(*b*), the stay portions 61, 62 of the front reinforcing member 6 and the stay portions 71, 72B of the rear reinforcing member 7 are formed separately with each other, respectively. The top edges of the medial side stay portions 61, 71 of the reinforcing members 6, 7 are provided in proximity with the eyelet stay portions 62, 72B, respectively. Thereby, it becomes unnecessary to form each of the reinforcing members 6, 7 integrally, thus costs can be reduced.

As shown by the broken line in FIG. 10(*a*), the first medial side stay portion 61 and the second medial side stay portion 71 are sewn to the rear edge of the front part 3 and the front edge of the rear part 4, respectively, together with cloths 57, 58 of the medial side stretchable part 51.

Fourth Embodiment

Figure 11A:
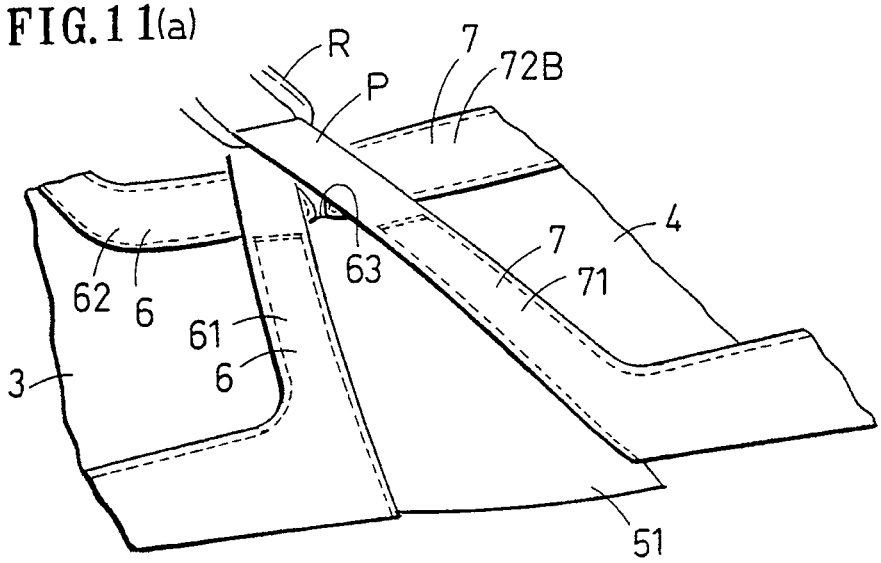
FIG. 11(*a*) is a perspective view showing a medial side stretchable part and its vicinity of a fourth embodiment and FIG. 11(*b*) is an exploded perspective view of the same.
Figure 11B:
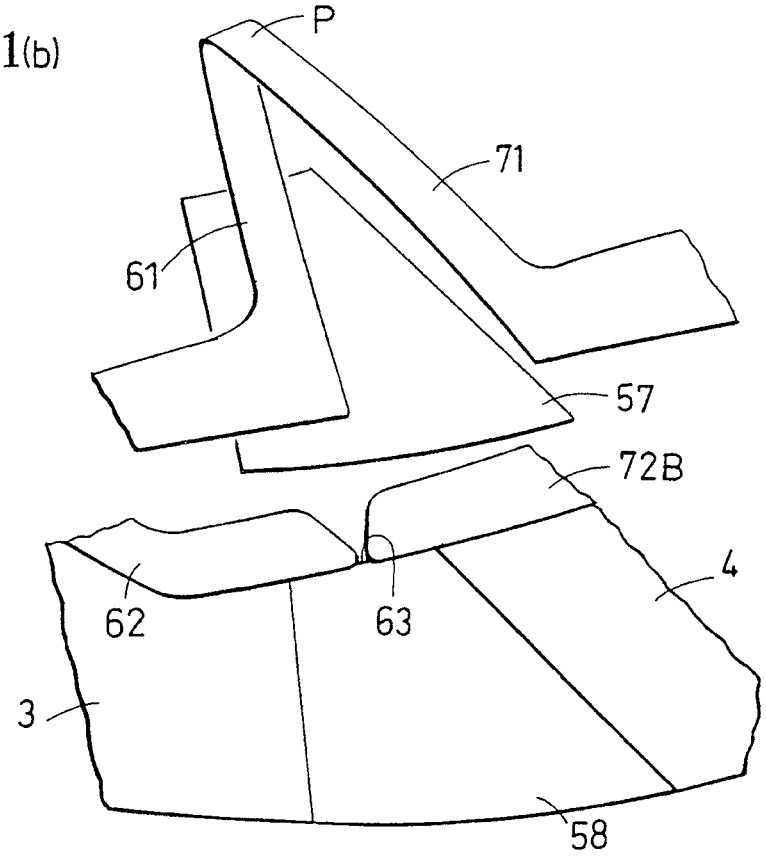

FIG. 11 show a fourth embodiment. FIG. 11(*a*) is a perspective view showing a medial side stretchable part and its vicinity and FIG. 11(*b*) is an exploded perspective view thereof.

In this embodiment, as shown in FIG. 11(*b*); the loop P is formed integrally with the first medial side stay portion 61 and the second medial side stay portion 71. The loop P is not sewn to the eyelet stay portions 62, 72B. Accordingly, the loop P allows the medial side stretchable part 51 to stretch and contract, similarly to the third embodiment.

Fifth Embodiment

Figure 12A:
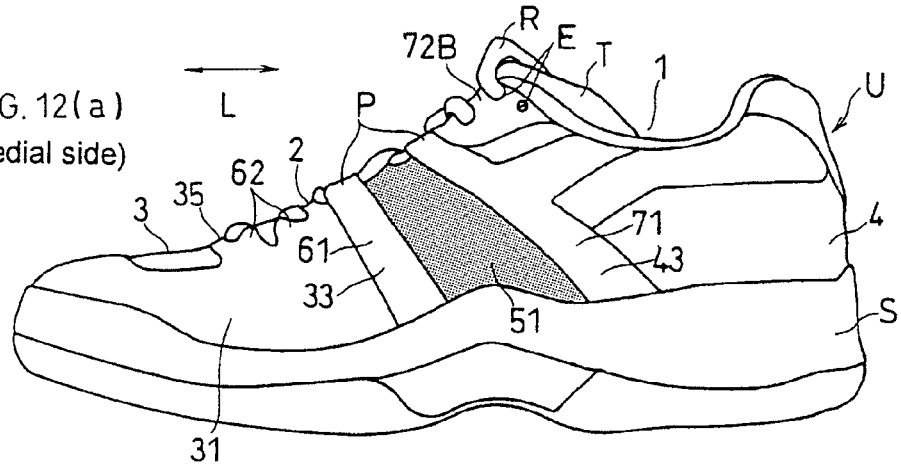
FIG. 12(*a*) and FIG. 12(*b*) are side views of a shoe of a fifth embodiment, medial side and lateral side view respectively, and FIG. 12(*c*) is a schematic side view (lateral side) showing the relationship between bones of the foot and the shoe.
Figure 12B:
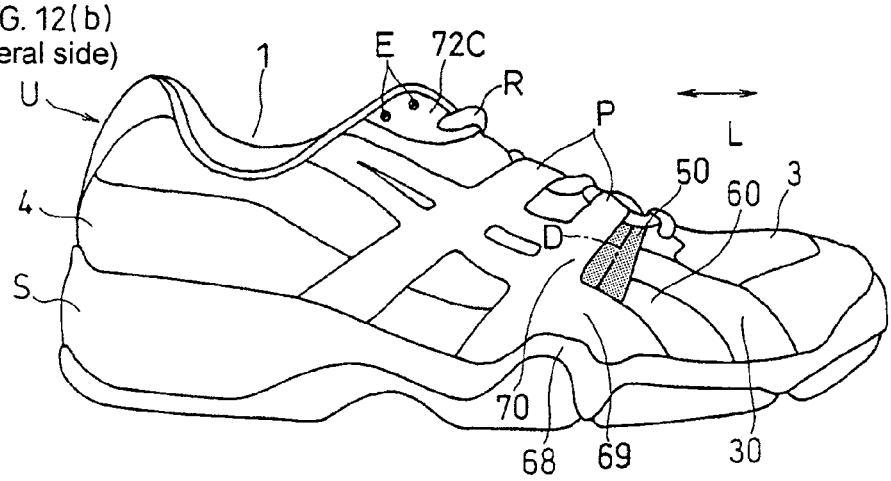
Figure 12C:
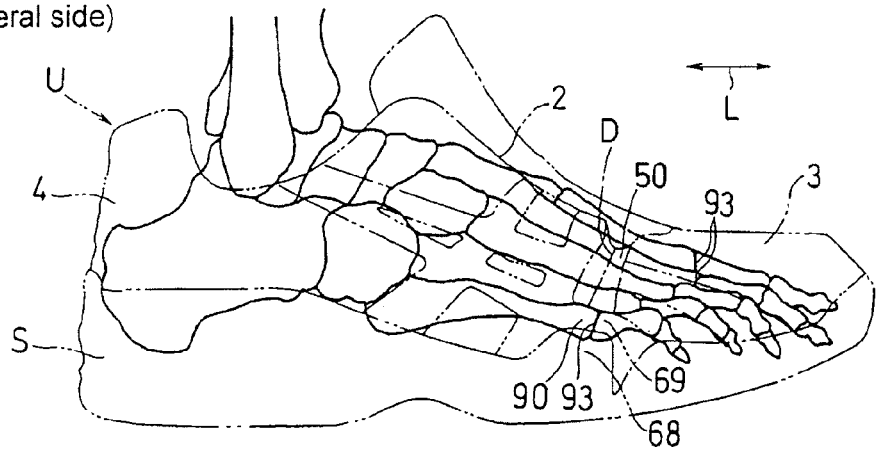
Figure 13A:
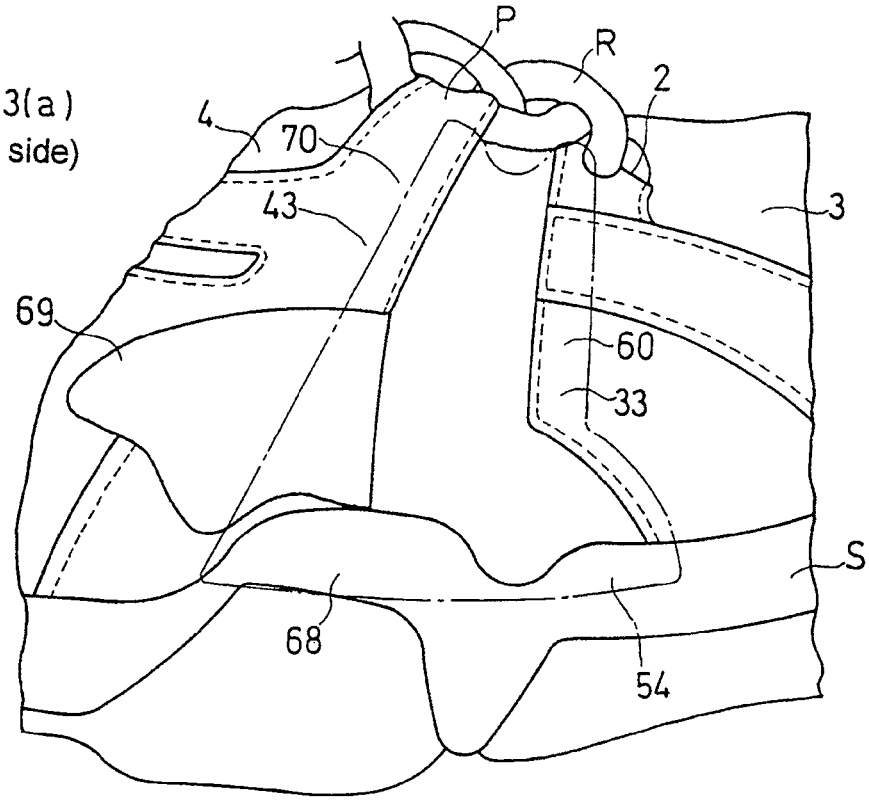
FIG. 13(*a*) and FIG. 13(*b*) are side views showing a lateral side stretchable part and its vicinity.
Figure 13B:
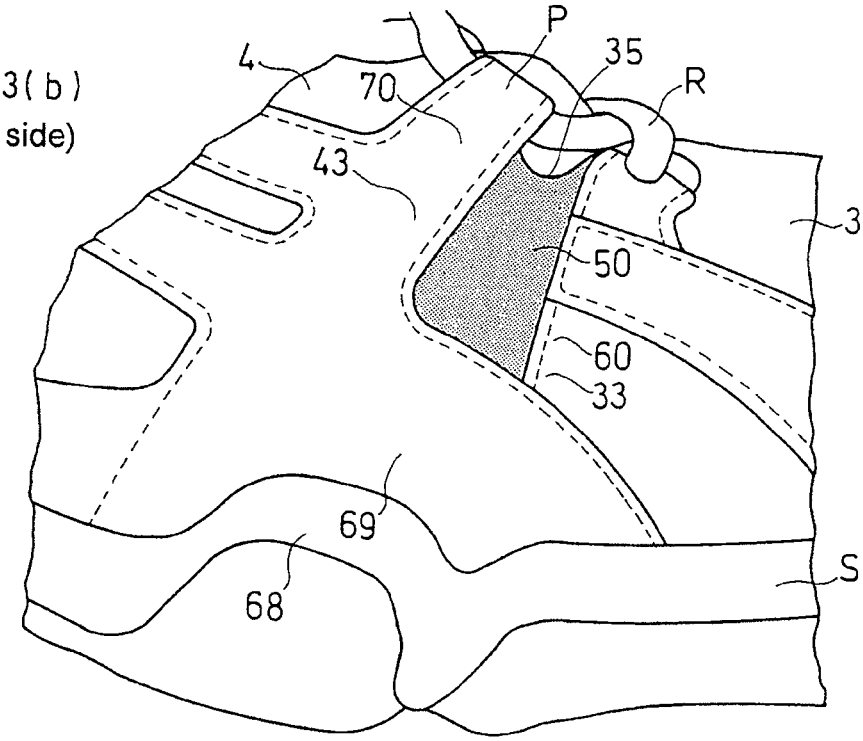

FIG. 12 and FIG. 13 show a athletic shoe for court (for example volleyball) according to a fifth embodiment. FIG. 12(*a*) shows a medial side face of a shoe (for a right foot) and FIG. 12(*b*) shows a lateral side face of such shoe. FIG. 12(*c*) shows the relationship between the bones of the foot and the lateral side face of the shoe. FIG. 13(*a*) and FIG. 13(*b*) are enlarged side views showing a lateral side stretchable part and its vicinity.

Figure 14A:
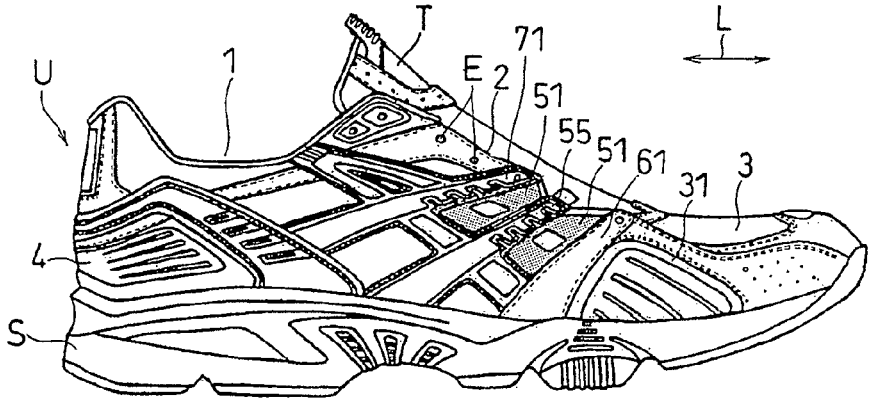
FIG. 14(*a*) and FIG. 14(*b*), are side views of a shoe of a sixth embodiment, medial side and lateral side view respectively, and FIG. 14(*c*) is a schematic side (lateral side) view showing the relationship between bones of the foot and the shoe FIG. 15(*a*), FIG. 15(*b*), FIG. 15(*c*), and FIG. 15(*d*) are side views showing the action of the stretchable part of the invention and FIG. 15(*e*) is a side view showing the related art.
Figure 14B:
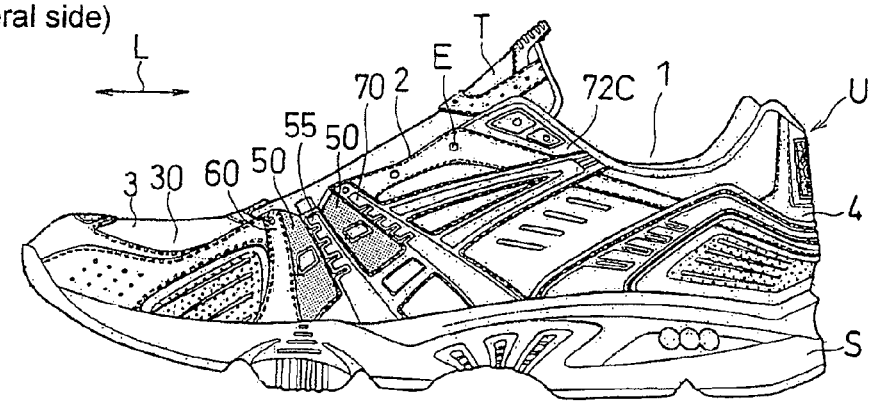
Figure 14C:
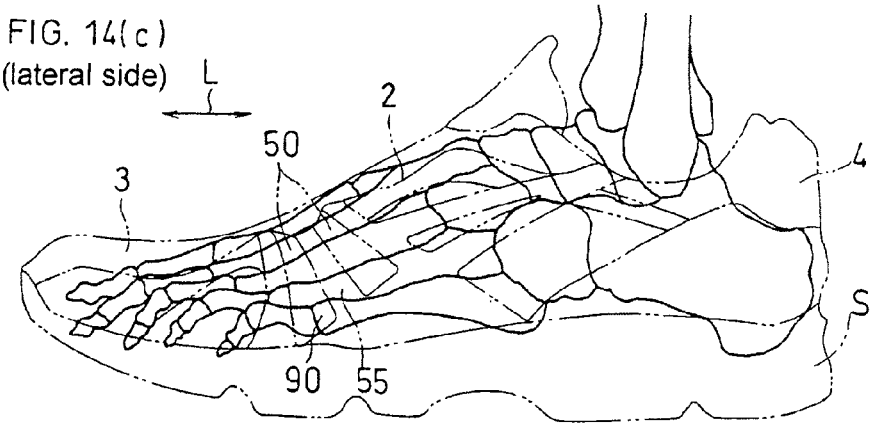
Figure 15A:
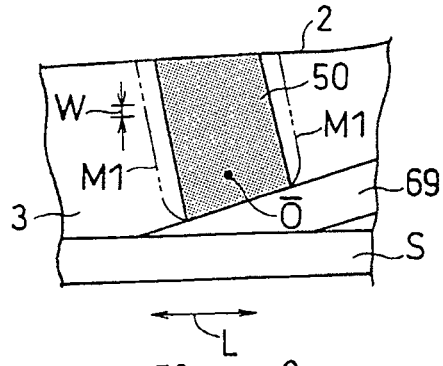
Figure 15B:
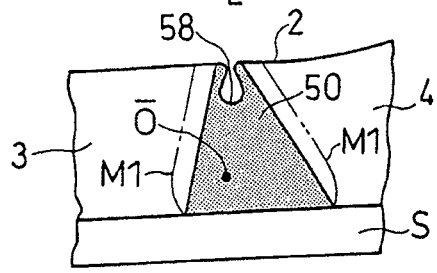
Figure 15C:
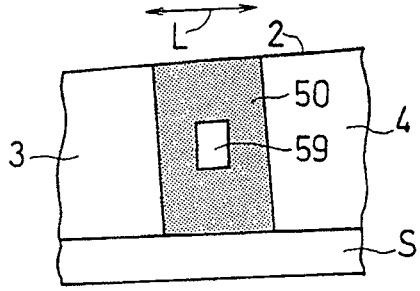
Figure 15D:
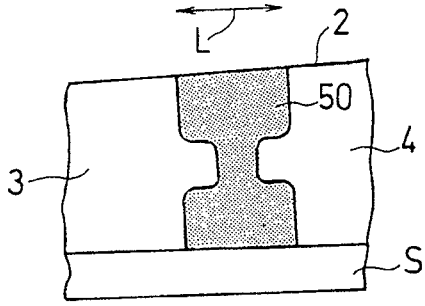
Figure 15E:
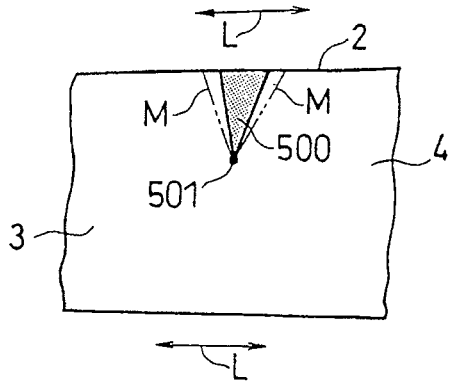
FIG. 15(e) PRIOR ART
Figure 17A:
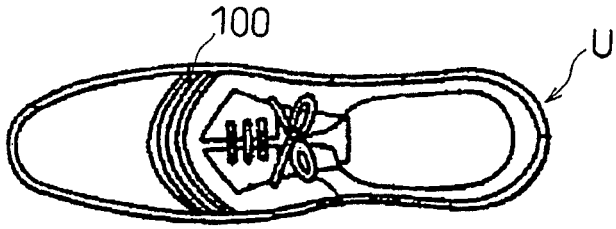
FIG. 17(a) PRIOR ART
FIG. 17(*a*) is a plan view and FIG. 17(*b*) is a side view showing another conventional shoes.
Figure 17B:
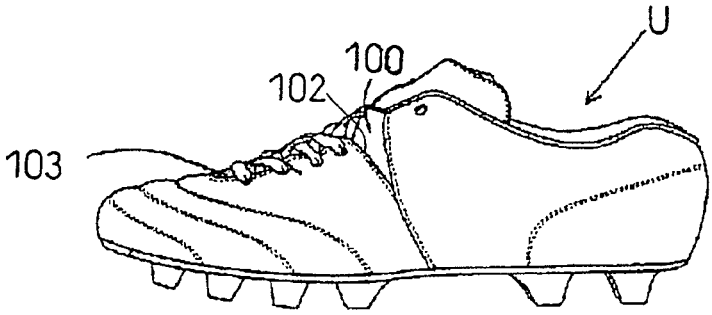
FIG. 17(b) PRIOR ART

In FIG. 12(*a*), FIG. 12(*b*), FIG. 13(*b*), FIG. 14(*a*) and FIG. 14(*b*), in order to understand easily the area where the stretchable part is provided, the stretchable parts are dot-meshed.

As shown in FIG. 12(*a*), the medial side stretchable part 51 of the shoe of this embodiment is provided so as to essentially cross medial side face 31 of the upper U from a top surface of the sole S to the second opening 2. This structure is similar to the first embodiment. The stretchable part 51 is formed to be approximately rectangular or square-shaped. The front eyelet stay portion 62 is provided separately on the medial side and the lateral side of the second opening 2 and is not provided in front of the second opening 2.

As shown in FIG. 12(*b*), on the lateral side face of the upper U, a connecting part 69 is provided below the lateral side stretchable part 50, continuously extending from the front part 3 to the rear part 4. The lateral side stretchable part 50 does not extends to the top surface of the sole S in appearance. The lateral side stretchable part 50 is provided so as to be over an approximately half of the upper U in height, extending downwards from the second opening 2. The connecting part 69 is formed of the same or similar material as second medial side stay portion 70, and the Young's modulus along the lengthwise direction L of the foot of the connecting part 69 is set larger than that of the lateral side stretchable part 50. Below the connecting part 69, a roll-up portion 68 is formed by making the sole S project upwards so as to be rolled up.

Next, the structure of the lateral side stretchable part 50 and its vicinity will be described.

Referring to FIGS. 13(*a*) and 13(*b*), a stretchable member 54 having stretching and contracting property is placed in an area surrounded by the first medial side stay portion 60, the second medial side stay portion 70 and the sole S (the area shown by one-dot chain line). Next, the connecting part 69 is sewn so as to cover the lower portion of the stretchable member 54 placed in above-described manner. This connecting part 69 is formed of material which is substantially difficult to stretch. On the other hand, a rectangular or square-shaped section, which is surrounded by the first lateral side stay portion 60, the second lateral side stay portion 70, the connecting part 69 and the rim 35 of the second opening 2, can stretch and contract, and this section defines the lateral side stretchable part 50.

The relationship between parts and portions in the vicinity of the lateral side stretchable part 50 and bones of the foot will be described.

Referring to FIGS. 12 (*b*) and 12 (*c*), the connecting part 69 and the roll-up portion 68, are located at a region corresponding to the distal caput of a fifth metatarsal bone on the lateral side of the foot. The connecting part 69 and the roll-up portion 68 are formed of a material which is substantially difficult to stretch. Accordingly, in an athletic shoe for court sports where violent motion of the foot in the widthwise direction occurs, the lateral side of said region is supported by the connecting part 69 and the roll-up portion 68. On the other hand, the lateral side stretchable part 50 is provided in an area extending from said region to the second opening 2. The lower end of the lateral side stretchable part 50 is at a location corresponding to the top edge of the distal caput 90 of a fifth metatarsal bone. That is, the lateral side stretchable part 50 extends from the second opening 2 to the location corresponding to the top end of the distal caput 90 of a fifth metatarsal bone. The area includes a line D which extends forwardly and obliquely upward from said region to the second opening 2. This allows the front part 3 of the upper U and that of the rear part 4 thereof to move independently from each other about the location along the metatarsophalangeal joint (MP joint) 93 of the foot as boundary. That is, the front part 3 of the upper U and the rear part 4 of the upper U move differently about the boundary corresponding to the MP joint.

Although, in this embodiment, the connecting part 69 and the second lateral side stay portion 70 are formed integrally, these may be formed separately from each other and the connecting part 69 may be formed integrally with the first lateral side stay portion 60. Furthermore, without providing the connecting part 69, only the roll-up portion 68 of the sole S may support the region corresponding to the distal caput of a fifth metatarsal bone 90.

Sixth Embodiment

FIG. 14 shows a trail shoe according to a sixth embodiment. FIG. 14(*a*) shows a medial side face of the shoe (for a left foot) of this embodiment, FIG. 14(*b*) shows a lateral side face of the same shoe, and FIG. 14(*c*) shows the relationship between bones of the foot and the lateral side face of the shoe.

The medial side stretchable part 51 of this embodiment, as shown in FIG. 14(*a*) is provided so as to be approximately half of the upper U in height, extending downwards from the second opening 2. This medial side and lateral side stretchable parts 51, 50 are arranged on opposite sides of the second opening 2. That is, the medial side stretchable part 51 faces opposite to the lateral side stretchable part 51 via the second opening 2. Such an arrangement of the stretchable parts is different from that in the above-described embodiments. A member formed of material which is substantially difficult to stretch is provided between the medial side stretchable part 51 and the sole S.

Further, a belt-like protecting member 55 which is substantially difficult to stretch is sewn onto the middle of the medial side stretchable part 51 in the longitudinal direction. Thereby with the provision of the protecting member 55, the medial side stretchable part 51 is longitudinally separated. This protecting member 55 protects the medial side stretchable part 51 which is not resistant to the shock from the exterior.

On the other hand, the lateral side stretchable part 50, as shown in FIG. 14(*c*), is provided in the same area as in the first embodiments (the area from a region corresponding to distal caput 90 of a fifth metatarsal bone to the second opening 2). The lateral side stretchable part 50 is longitudinally separated by a protecting member 55, similar to the medial side stretchable part 51. A front region of the separated lateral side stretchable part 51, as shown in FIG. 14(*b*), crosses a lateral side face 30 of the upper U from a top surface of the sole S to the second opening 2.

The direction of strain on the foot at the time of going up and down a mountain is different from that at the time of running. Thus the shoes must be constructed differently. By sewing said protecting member 55 and any non-stretchable member onto the stretchable part 51, 50 in an appropriate position, it becomes possible to adjust the direction in which the stretchable parts 51, 50 can stretch and contract to conform them to the strain on the foot.

In order to protect the region corresponding to head of the navicular bone and its vicinity, said region may be covered with the rear part 4 of the upper from medial side of the foot.

Action of the Lateral Side Stretchable Part

In the above-described six embodiments, the lateral side stretchable part 50 is formed to be substantially rectangular, square-shaped or trapezoid-shaped resembling triangle, and to have a longitudinal length in a region corresponding to distal caput 90 of a fifth metatarsal bone and in its neighborhood, as shown in FIG. 14(*c*). The action caused by such formation of the lateral side stretchable part will be described below referring to the schematic views of the lateral side stretchable part (FIG. 15(*a*) to FIG. 15(*e*)). In FIG. 15(*a*) to FIG. 15(*e*), in order to understand easily the area where the stretchable parts are provided, the stretchable parts are dot-meshed.

In the prior art (FIG. 15(*e*)), a small stretchable part 500 which is formed to be an inverted triangle is provided on the lateral side of the foot. When a force in the lengthwise direction L of the foot is applied to the stretchable part 500, the stretchable part 500 stretches as shown by two-dot line M of the same figure. In this case, elongation percentage at a bottom point 501 of the stretchable part 500 is zero. That is, since the inverted triangular stretchable part 500 has no certain length in the lengthwise direction L of the foot at its bottom, it can stretch little at the bottom. Accordingly, the upper can stretch little in the lengthwise direction L of the foot in almost all of the lateral side face of the upper.

Referring to this invention, as shown in FIG. 15(*a*), wherein the lateral side stretchable part 50 is formed to be substantially rectangular or square-shaped. A connecting part 69 which is hard to stretch and contract is provided between the lateral side stretchable part 50 and the sole S. In such a structure, when a force in the lengthwise direction L of the foot is applied to the lateral side stretchable part 50, the lateral side stretchable part 50 stretches as shown by two-dot line M1 of the same figure. In this case, since the lateral side stretchable part 50 has a certain length in the lengthwise direction L of the foot at a region (a point) O which is in the vicinity of said distal caput 90 of a fifth metatarsal bone, this region can stretch in the lengthwise direction L of the foot. That is, the lateral side stretchable part 50 can stretch and contract longitudinally in an area from a region to the second opening 2.

On the other hand, as shown in FIG. 15(*b*), the lateral side stretchable part 50, which is formed to be substantially trapezoidal resembling to a triangle, is provided from the second opening 2 to the top surface of the sole S.

In such a structure, the lateral side stretchable part 50 in the vicinity of the second opening 2 is very short in length. However, the lateral side stretchable part 50 has a V-shaped or U-shaped notched portion 58. Therefore, in such a structure, the lateral side stretchable part 50 also can stretch and contract in the lengthwise direction L of the foot in the vicinity of the second opening 2.

Thus, the lateral side stretchable part 50, substantially in the shape of a trapezoid, rectangle or square, can deform to various shapes according to external force. Therefore, at the time of exercise, the lateral side stretchable part 50 stretches according to the deformation of the foot so that the front part 3 and the rear part 4 of the upper U can move independently from each other about a boundary near the distal caput (head) 90 of a fifth metatarsal bone. As a result, the upper can deform in accordance with the motions of the front foot portion and the rear foot portion, which are different from each other.

Therefore, if the lateral side stretchable part 50 has stretching and contracting means for stretching and contracting along the lengthwise direction L of the foot in the area from the region O in the vicinity of the distal caput 90 of a fifth metatarsal bone to the second opening 2, the upper U can deform easily and sufficiently in accordance with the motions of the front foot portion and the rear foot portion which differ from each other about the lateral side stretchable part 50 as boundary.

The stretching and contracting means in the area including said region O can be realized by forming the lateral side stretchable part 50 so as to have a certain length in said area.

In the case where high stretching and contracting property is necessary for shoes, for example in the case of running shoes, the lateral side stretchable part 50 is provided so as to cross the lateral side face of the upper U from the second opening 2 to the top surface of the sole S. In the case where proper stretching and contracting property and sufficient support of the foot are necessary for shoes, for example in the case of athletic shoes for court sports, trail shoes and so on, a connecting part 69 may be provided between the lateral side stretchable part 50 and the sole S or the lateral side stretchable part 50 may be formed so as to have no sufficient length to stretch at the top surface of the sole S.

On the other hand, the stretching and contracting means in the vicinity of the second opening 2 can be realized by forming the lateral side stretchable part 50 so as to have a certain length along the vicinity of the second opening 2. Even if the lateral side stretchable part 50 is formed to be substantially triangular so that said length along the second opening 2 is very short, said stretching and contracting means can be realized by forming the lateral side stretchable part 50 so as to have a U-shaped or V-shaped notched portion 58 in the vicinity of the second opening 2.

In the lateral side stretchable part 50 formed to be substantially rectangular or square-shaped, a member 59 which is hard to stretch and contract may be provided isolated in the central region of the lateral side stretchable part 50, as shown in FIG. 15(*c*). The lateral side stretchable part 50 may be formed to be in the shape constricted in the middle in the vertical direction, as shown in FIG. 15(*d*).

Further, in order to prevent unnecessary stretching and to provide sufficient stretch of the lateral side stretchable part 50, the "elastic constant" k per unit height W (FIG. 15(*a*)) of the lateral side stretchable part 50 is preferably set between about 0.1 N/mm and 50 N/mm. Said "elastic constant" is defined as a value obtained by cutting the stretchable part into a test piece which is slender and long in the lengthwise direction of the foot, applying a load f in the longitudinal direction to the test piece and dividing the load f by a strain $\epsilon$ of the test piece and a width W of the test piece. That is, this "elastic constant" k is given by the following expression (1).

$$k=f/(\epsilon\cdot W) \quad (1)$$

The reason why conception of above "elastic constant" is introduced is that thickness of material of the upper cannot be ambiguous. That is, the correct thickness of the upper is difficult to measure. Therefore, it is different to obtain the correct value of the following Young's modulus of the material of the upper. The "elastic constant" k can be obtained without measuring the correct thickness of the material of the upper.

Young's modulus is obtained by dividing the load f by a strain $\epsilon$ of the test piece and a transverse sectional area S of the test piece. That is, Young's modulus E is given by the following expression (2).

$$k=f/(\epsilon\cdot S) \quad (2)$$

Preferred values of the "elastic constant" k vary with the shape, size and type of shoe and the shape and size of the stretchable parts. For example, it is preferable to set said "elastic constant" k approximately between 0.1 N/mm and 7.0 N/mm in the shoes shown in FIG. 1 to FIG. 11(*b*), FIG. 14(*a*) to FIG. 14(*c*). In the running shoes shown in FIG. 1 to FIG. 11(*b*), it is preferred to set the "elastic constant" k approximately between 0.1 N/mm and 3.0 N/mm. In the athletic shoes for court sports shown in FIG. 12(*a*) to FIG. 13(*b*), it is preferable to set the "elastic constant" k approximately between 10 N/mm and 30 N/mm. In the trail shoe shown in FIG. 14(*a*) to FIG. 14(*c*), it is preferable to set the "elastic constant" k approximately between 1.0 N/mm and 7.0 N/mm.

These specific values of the "elastic constant" k are supposed to be set larger than the "elastic constant" k of conventional stretchable material. In the present invention, the stretchable part 50 is necessarily formed to have a certain length in the lengthwise direction L of the foot. Accordingly, when the stretchable part 50 is formed to be too stretchable, the function of the upper U to keep the stability of the foot decrease too much. Because of this, the "elastic constant" k of the stretchable part 50 is set large to a certain extent, according as the stretchable part 50 is formed to have said length in the lengthwise direction L of the foot.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of the invention.

Industrial Applicability

The present invention is applicable to athletic shoes for court sports such as volleyball, basketball, tennis etc., trail shoes for mountain climbing etc., golf shoes, football shoes and so on, in addition to running shoes and walking shoes. For example, in the case where the present invention is applied to a golf shoe having a hard sole made of resin, a bending groove may be formed on the sole in a position corresponding to the stretchable parts so that the fitting property of the shoe is improved.

What is claimed is:

1. An athletic shoe suitable for exercise comprising a sole for absorbing shock of landing and an upper for covering an instep of a foot, the sole comprising a plurality of layers, wherein:

the upper defines a first opening out of which the foot sticks upwards during wearing and a second opening being placed anterior to the first opening and opening in an upper surface of the instep and covered with a tongue, the two openings being continuous with each other in a longitudinal direction, and the upper comprises:

a medial side surface of the upper which covers a medial side of the foot;

a lateral side surface of the upper which covers a lateral side of the foot; and a medial side stretchable part formed on the medial side surface of the upper from a top surface of the sole to the second opening, wherein the medial side stretchable part has a Young's modulus along a lengthwise direction of the foot less than a Young's modulus of a remaining portion of the medial side surface of the upper, wherein all remaining portions of the medial side surface of the upper and a part opposite to the medial side stretchable part in the lateral side surface are covered by a material whose stretching and contracting property is less than that of the medial side stretchable part, wherein the medial side stretchable part is provided on the medial side of the foot at a location corresponding substantially to Lisfranc's joint, and wherein both a front edge and rear edge enclosing respective sides of the medial stretchable part extend in a rear direction of the foot as the front edge and rear edge get close to the sole from the second opening, and upper ends of the front edge and rear edge are positioned anterior to a front end of the first opening, wherein a part corresponding to a distal caput of a fifth metatarsal bone in the lateral side surface is covered with a material being substantially more difficult to stretch than the medial side stretchable part, and wherein the medial side stretchable part is provided from the top surface of the sole to the second opening and is in contact with the second opening.

2. An athletic shoe according to claim 1, wherein a roll-up portion in which the sole rolls up upwards is provided below the part corresponding to the distal caput of the fifth metatarsal bone.

3. An athletic shoe according to claim 1, wherein:

the upper further comprises a lateral side stretchable part on a lateral side surface of the upper; and a Young's modulus of the lateral side stretchable part along the lengthwise direction of the foot is less than a Young's modulus of a remaining portion of the lateral side surface of the upper.

4. An athletic shoe according to claim 1, wherein the sole comprises an outsole that is continuous from a front portion of the sole to a rear portion of the sole.

* * * * *